US010216128B2

(12) United States Patent
Haruyama

(10) Patent No.: US 10,216,128 B2
(45) Date of Patent: Feb. 26, 2019

(54) FIXING DEVICE AND IMAGE FORMING APPARATUS

(71) Applicant: Oki Data Corporation, Tokyo (JP)

(72) Inventor: Masahiro Haruyama, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/680,914

(22) Filed: Aug. 18, 2017

(65) Prior Publication Data

US 2018/0059592 A1 Mar. 1, 2018

(30) Foreign Application Priority Data

Aug. 30, 2016 (JP) ..... 2016-168111

(51) Int. Cl.
*G03G 15/20* (2006.01)

(52) U.S. Cl.
CPC . *G03G 15/2053* (2013.01); *G03G 2215/2009* (2013.01); *G03G 2215/2022* (2013.01)

(58) Field of Classification Search
CPC ..... G03G 15/2053
See application file for complete search history.

(56) References Cited

U.S. PATENT DOCUMENTS

2010/0172677 A1* 7/2010 Hosokawa ..... G03G 15/2064 399/329
2011/0008085 A1* 1/2011 Okamoto ..... G03G 15/2025 399/329
2013/0266349 A1* 10/2013 Yoshimura ..... G03G 15/6585 399/320
2014/0093290 A1* 4/2014 Soeda ..... G03G 15/2039 399/329

FOREIGN PATENT DOCUMENTS

JP 2013-073207 A 4/2013

* cited by examiner

*Primary Examiner* — Clayton E Laballe
*Assistant Examiner* — Jas Sanghera
(74) *Attorney, Agent, or Firm* — Rabin & Berdo, P.C.

(57) ABSTRACT

A fixing device includes a first unit including a first belt movable in a first direction; a first pressing member pressing the first belt; a first pressing member support supporting the first pressing member variably in attitude relative to the first pressing member support; a first rotating member in contact with the first belt and rotatable in a first rotation direction; and a first rotating member support that supports the first rotating member variably in position relative to the moving member; a second unit facing the first unit in a second direction and including a moving member movable in the first direction to come into contact with the first belt; and a third unit facing the second unit with the first unit in between in the second direction and supported by the second and third units movably in the second direction between the second unit and the third unit.

17 Claims, 19 Drawing Sheets

REGULAR PRESSURE MODE

REGULAR PRESSURE MODE

REDUCED PRESSURE MODE (MODIFICATION EXAMPLE)

REDUCED PRESSURE MODE (MODIFICATION EXAMPLE)

SEPARATED MODE

SEPARATED MODE

FIXING DEVICE AND IMAGE FORMING APPARATUS

CROSS REFERENCE TO RELATED APPLICATIONS

The present application claims priority from Japanese Patent Application No. 2016-168111 filed on Aug. 30, 2016, the entire contents of which are hereby incorporated by reference.

BACKGROUND

The technology relates to a fixing device and an image forming apparatus provided with the fixing device.

An image forming apparatus has been proposed that is provided with a fixing device that fixes a developer image onto a medium by use of a belt, for example, as disclosed in Japanese Unexamined Patent Application Publication No. 2013-73207.

SUMMARY

An image forming unit provided with a fixing device that fixes a developer image onto a medium by use of a belt is able to form a high-quality image, for example, by performing a fixing operation that involves application of stable pressure to a medium through the belt.

It is desirable to provide a fixing device and an image forming apparatus that are suitable for achieving an image with improved quality.

According to one embodiment of the technology, there is provided a fixing device including a first unit and a second unit. The first unit that includes: a first belt being movable in a first direction; a first pressing member pressing the first belt; and a first pressing member support supporting the first pressing member. The second unit includes a moving member and faces the first unit in a second direction. The moving member is able to come into contact with the first belt and movable in the first direction. The first pressing member is supported, by the first pressing member support, variably in attitude of the first pressing member relative to the first pressing member support.

According to one embodiment of the technology, there is provided an image forming apparatus provided with a fixing device. The fixing device includes a first unit and a second unit. The first unit that includes: a first belt being movable in a first direction; a first pressing member pressing the first belt; and a first pressing member support supporting the first pressing member. The second unit includes a moving member and faces the first unit in a second direction. The moving member is able to come into contact with the first belt and movable in the first direction. The first pressing member is supported, by the first pressing member support, variably in attitude of the first pressing member relative to the first pressing member support.

DETAILED DESCRIPTION

Some example embodiments of the technology are described below in detail with reference to the accompanying drawings. It is to be noted that the description below describes mere specific examples of the technology, and the technology is therefore not limited thereto. Further, the technology is not limited to factors such as arrangements, dimensions, and dimension ratios of components illustrated in the respective drawings. Further, elements in the following example embodiments which are not recited in a most-generic independent claim of the technology are optional and may be provided on an as-needed basis. The description is given in the following order.

1. Example Embodiment

An image forming apparatus provided with a fixing device serving as a belt unit

2. Modification Examples

An image forming apparatus provided with a transferring unit serving as the belt unit

1. Example Embodiment

[Outline Configuration of Image Forming Apparatus 1]

Figure 1A:
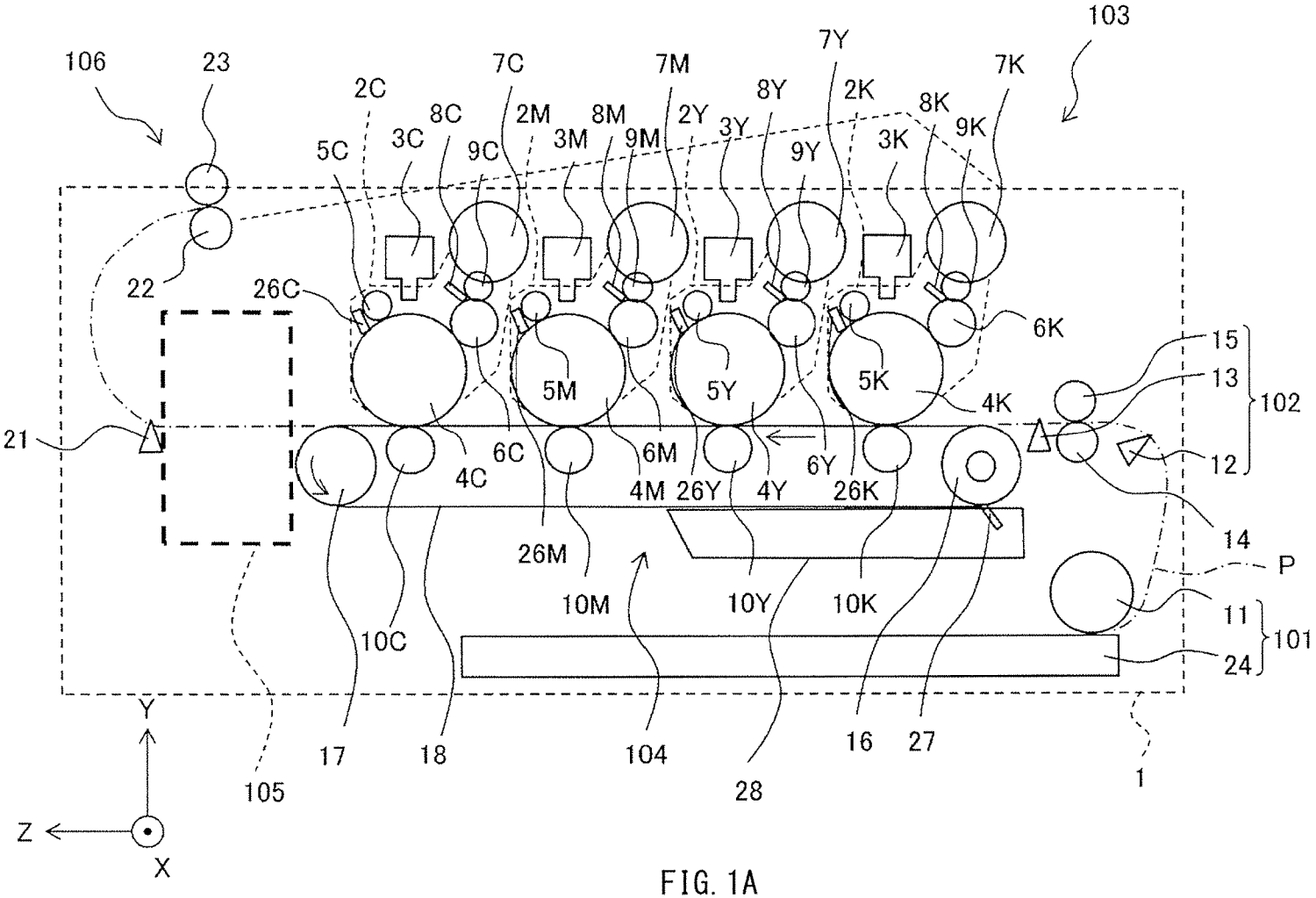
FIG. 1A schematically illustrates an overall configuration example of an image forming apparatus according to one example embodiment of the technology.
Figure 1B:
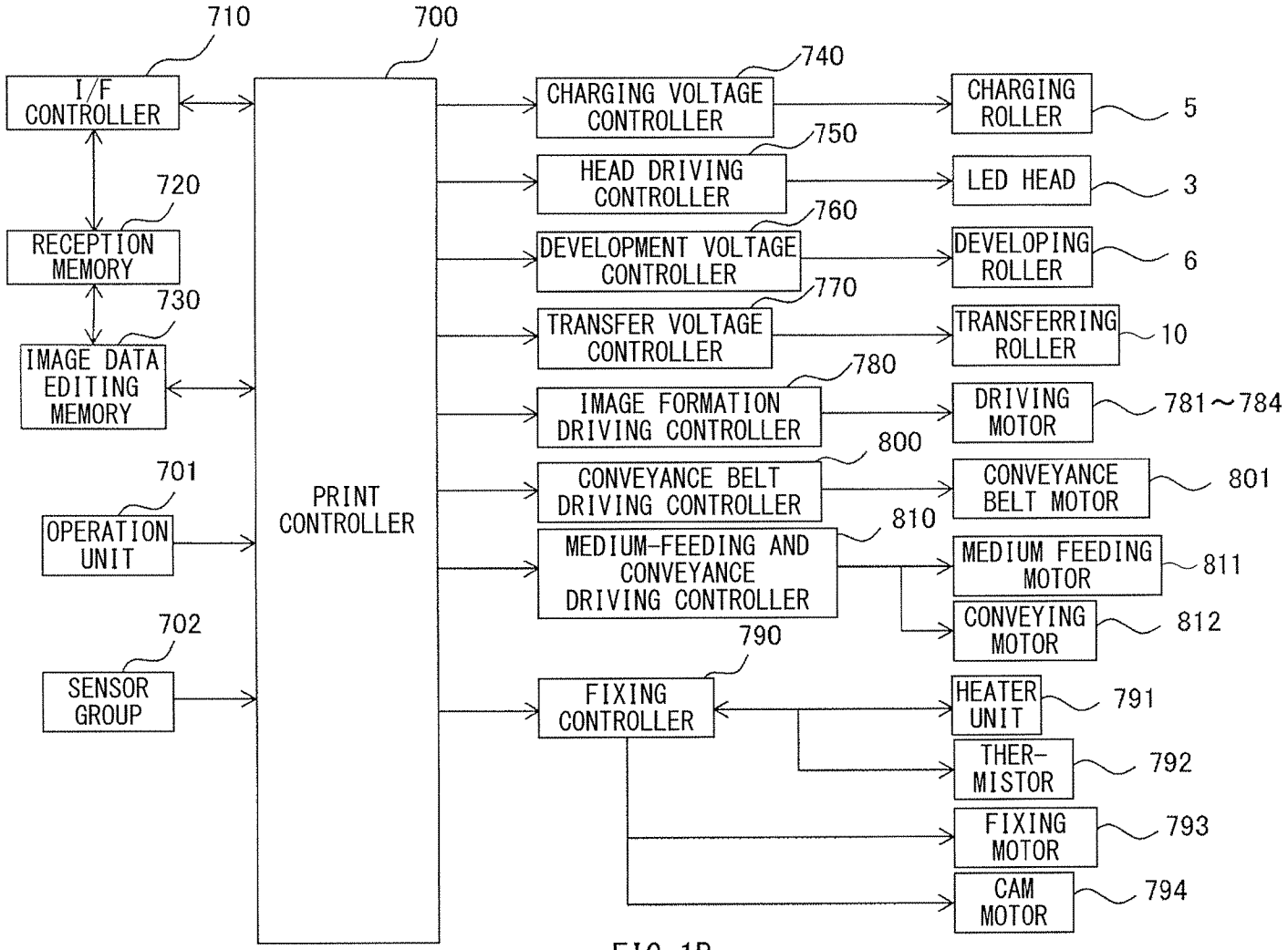
FIG. 1B is a block diagram schematically illustrating a configuration example inside the image forming apparatus illustrated in FIG. 1A.

FIG. 1A schematically illustrates an overall configuration example of an image forming apparatus 1 mounted with a fixing device 105 according to one example embodiment of the technology. The fixing device 105 may serve as a belt unit. FIG. 1B is a block diagram corresponding to an internal configuration of the image forming apparatus 1 illustrated in FIG. 1A. The image forming apparatus 1 may be an electrophotographic printer that forms an image such as a color image on a recording medium, for example. Non-limiting examples of the recording medium may include a sheet and a film. The recording medium may be also referred to as a print medium or a transfer material. It is to be noted that a direction that is orthogonal to a direction in which the recording medium is to be conveyed, i.e., an X-axis direction that is orthogonal to the paper plane of FIG. 1A, is referred to as a width direction herein. Further, a direction in which the recording medium is to be conveyed inside the fixing device 105 is referred to as a Z-axis direction, and a height direction that is orthogonal to both the X-axis direction and the Z-axis direction is referred to as a Y-axis direction, as will be described later in greater detail.

The image forming apparatus 1 may include, inside a housing, a medium feeding unit 101, a medium conveying unit 102, an image forming unit 103, a transferring unit 104, the fixing device 105, and a discharging unit 106, for example.

[Medium Feeding Unit 101]

The medium feeding unit 101 may include a medium cassette (a medium feeding tray) 24 and a medium feeding roller 11, for example. The medium cassette 24 may contain the recording medium. The medium feeding roller 11 may pick up the recording media separately one by one from the medium cassette 24, and feed the recording medium picked up toward the medium conveying unit 102.

[Medium Conveying Unit 102]

The medium conveying unit 102 may include a position sensor 12, a pair of conveying rollers 14 and 15 that face each other, and a position sensor 13 in order from upstream side, for example. Each of the position sensors 12 and 13 may detect a position of the recording medium that travels along a conveyance path P. The pair of conveying rollers 14 and 15 may convey the recording medium fed by the medium feeding roller 11 toward the image forming unit 103 that is provided downstream of the medium conveying unit 102.

[Image Forming Unit 103]

The image forming unit 103 may form a toner image (a developer image). The transferring unit 104 may transfer, onto the recording medium, the toner image formed in the image forming unit 103. The image forming unit 103 may include four image forming units, i.e., image forming units 2K, 2Y, 2M, and 2C, for example. The image forming units 2K, 2Y, 2M, and 2C may include light-emitting diode (LED) heads 3K, 3Y, 3M, and 3C, photosensitive drums 4K, 4Y, 4M, and 4C, charging rollers 5K, 5Y, 5M, and 5C, developing rollers 6K, 6Y, 6M, and 6C, toner tanks 7K, 7Y, 7M, and 7C, developing blades 8K, 8Y, 8M, and 8C, toner feeding sponge rollers 9K, 9Y, 9M, and 9C, and photosensitive-drum blades 26K, 26Y, 26M, and 26C, respectively.

Each of the LED heads 3K, 3Y, 3M, and 3C may perform exposure of a surface of facing one of the photosensitive drums 4K, 4Y, 4M, and 4C, and thereby form an electrostatic latent image on the surface of the corresponding one of the photosensitive drums 4K, 4Y, 4M, and 4C.

Each of the photosensitive drums 4K, 4Y, 4M, and 4C may be a columnar member having a surface (a surficial part) that supports an electrostatic latent image. Each of the photosensitive drums 4K, 4Y, 4M, and 4C may include a photoreceptor such as an organic photoreceptor.

Each of the charging rollers 5K, 5Y, 5M, and 5C may be a charging member that charges the surface (the surficial part) of corresponding one of the photosensitive drums 4K, 4Y, 4M, and 4C. Each of the charging rollers 5K, 5Y, 5M, and 5C may be so disposed as to be in contact with a surface (a circumferential surface) of the corresponding one of the photosensitive drums 4K, 4Y, 4M, and 4C.

Each of the developing rollers 6K, 6Y, 6M, and 6C may have a surface that supports the toner to be used for development of the electrostatic latent image. Each of the developing rollers 6K, 6Y, 6M, and 6C may be so disposed as to be in contact with the surface (the circumferential surface) of the corresponding one of the photosensitive drums 4K, 4Y, 4M, and 4C.

Each of the toner tanks 7K, 7Y, 7M, and 7C may be a container that contains the toner and have a toner discharging opening at a lower part of the container.

Each of the developing blades 8K, 8Y, 8M, and 8C may be a toner controlling member that forms a layer including the toner, i.e., a toner layer, on a surface of corresponding one of the developing rollers 6K, 6Y, 6M, and 6C that rotate, and control or adjust a thickness of the toner layer to be formed. Each of the developing blades 8K, 8Y, 8M, and 8C may be a plate-like elastic member including a material such as stainless steel, for example. For example, each of the developing blades 8K, 8Y, 8M, and 8C may be a plate spring. Each of the developing blades 8K, 8Y, 8M, and 8C may be so disposed that a tip of the plate-like elastic member is disposed in the vicinity of the surface of the corresponding one of the developing rollers 6K, 6Y, 6M, and 6C.

Each of the toner feeding sponge rollers 9K, 9Y, 9M, and 9C may be a feeding member that feeds the toner to corresponding one of the developing rollers 6K, 6Y, 6M, and 6C. Each of the toner feeding sponge rollers 9K, 9Y, 9M, and 9C may be so disposed as to be in contact with a surface (a circumferential surface) of the corresponding one of the developing rollers 6K, 6Y, 6M, and 6C.

Each of the photosensitive-drum blades 26K, 26Y, 26M, and 26C may be a cleaning member that scrapes and collects the toner remained on the surface (the surficial part) of corresponding one of the photosensitive drums 4K, 4Y, 4M, and 4C to thereby cleans the surface of the corresponding one of the photosensitive drums 4K, 4Y, 4M, and 4C. Each of the photosensitive-drum blades 26K, 26Y, 26M, and 26C may be so disposed as to come into contact with the surface of the corresponding one of the photosensitive drums 4K, 4Y, 4M, and 4C in a counter direction. In other words, each of the photosensitive-drum blades 26K, 26Y, 26M, and 26C may be so disposed as to protrude in a direction opposite to a direction in which the corresponding one of the photosensitive drums 4K, 4Y, 4M, and 4C rotates. Each of the photosensitive-drum blades 26K, 26Y, 26M, and 26C may include an elastic material such as polyurethane rubber, for example.

[Transferring Unit 104]

The transferring unit 104 may include a conveyance belt 18, a driving roller 17, a driven roller 16, transfer rollers 10K, 10Y, 10M, and 10C, a belt blade 27, and a waste toner box 28, for example. The driving roller 17 may drive the conveyance belt 18. The driven roller 16 may be driven in accordance with the driving roller 17. The transfer rollers 10K, 10Y, 10M, and 10C may respectively face the photosensitive drums 4K, 4Y, 4M, and 4C with the conveyance belt 18 in between.

The conveyance belt 18 may be an endless elastic belt that includes a resin material such as polyimide resin, for example. The conveyance belt 18 may lie on the driving roller 17, the driven roller 16, and the transfer rollers 10K, 10Y, 10M, and 10C, while being stretched. The conveyance belt 18 may be thereby rotated circularly in a direction indicated by an arrow illustrated in FIG. 1A. The driving roller 17 may drive the conveyance belt 18 by means of drive force supplied from a conveyance belt motor 801 which will be described later in greater detail. Each of the transfer rollers 10K, 10Y, 10M, and 10C may electrostatically transfer, onto the recording medium, the toner image formed in corresponding one of the image forming units 2K, 2Y, 2M, and 2C, while conveying the recording medium in a conveyance direction in which the recording medium is to be conveyed. Each of the transfer rollers 10K, 10Y, 10M, and 10C may include a foamed electrically-semiconductive elastic rubber material, for example. Each of the driving roller 17, the driven roller 16, and the transfer rollers 10K, 10Y, 10M, and 10C may be a substantially-columnar member that extends in a lateral direction and is rotatable. The lateral direction refers to a direction that is perpendicular to the paper plane of FIG. 1A. The belt blade 27 may scrape the waste toner remained on the surface of the conveyance belt 18 to thereby perform cleaning of the surface of the conveyance belt 18. The waste toner box 28 may recover the waste toner scraped by the belt blade 27, and store the recovered waste toner.

[Fixing Device 105]

The fixing device 105 may apply heat and pressure to the toner image transferred on the recording medium that has been conveyed from the transferring unit 104, and thereby fix the toner image onto the recording medium. The fixing device 105 may include a heater unit 791, a thermistor 792, a fixing motor 793, and a cam motor 794. The heater unit 791 may include heaters 50B, 50F, and 55L each of which will be described later in greater detail. The fixing device 105 will be also described later in greater detail.

[Discharging Unit 106]

The discharging unit 106 may include a position sensor 21 and discharging rollers 22 and 23. The discharging rollers 22 and 23 may face each other. The position sensor 21 may detect a position of the recording medium that is discharged from the fixing device 105 and travels along the conveyance path P. The discharging rollers 22 and 23 may discharge, to the outside, the recording medium that has been discharged from the fixing device 105.

Referring to FIG. 1B, the image forming apparatus 1 may include a print controller 700, an interface (I/F) controller 710, a reception memory 720, an image data editing memory 730, an operation unit 701, and a sensor group 702. The image forming apparatus 1 may further include a charging voltage controller 740, a head driving controller 750, a development voltage controller 760, a transfer voltage controller 770, an image formation driving controller 780, a fixing controller 790, a conveyance belt driving controller 800, and a medium-feeding and conveyance driving controller 810 that each receive an instruction from the print controller 700.

The print controller 700 may include components such as a microprocessor, a read-only memory (ROM), a random-access memory (RAM), and an input-output port, for example. The print controller 700 may control the process operation as a whole of the image forming apparatus 1 by executing a predetermined program, for example. Specifically, the print controller 700 may receive, for example, print data and a control command from the I/F controller 710, and perform general controls of the charging voltage controller 740, the head driving controller 750, the development voltage controller 760, the transfer voltage controller 770, the image formation driving controller 780, the fixing controller 790, the conveyance belt driving controller 800, and the medium-feeding and conveyance driving controller 810. The print controller 700 may thereby perform a printing operation.

The I/F controller 710 may receive, for example, the print data and the control command from an external device such as a personal computer (PC), and transmit a signal related to a state of the image forming apparatus 1.

The reception memory 720 may temporarily store the print data supplied from the external device such as the PC via the I/F controller 710.

The image data editing memory 730 may receive the print data that has been stored in the reception memory 720, and store image data resulting from editing of the received print data.

The operation unit 701 may include components such as an LED lamp and an input unit, for example. The LED lamp may be provided for displaying information such as the state of the image forming apparatus 1, for example. The input unit may include components such as a button and a touch panel, and allow a user of the image forming apparatus 1 to give an instruction to the image forming apparatus 1.

The sensor group 702 may include various sensors that monitor an operation state of the image forming apparatus 1. Non-limiting examples of the various sensors may include the position sensors 12, 13, and 21 that detect the position of the recording medium, a temperature sensor 29 that detects the temperature inside the image forming apparatus 1, and a print density sensor 30.

The charging voltage controller 740 may so perform a control as to apply a charging voltage to the charging rollers 5, i.e., the charging rollers 5K, 5Y, 5M, and 5C, and thereby charge the respective surfaces of the photosensitive drums 4, i.e., the photosensitive drums 4K, 4Y, 4M, and 4C, in response to the instruction given by the print controller 700.

The head driving controller 750 may perform a control of an exposure operation performed by the LED heads 3, i.e., the LED heads 3K, 3Y, 3M, and 3C, on the basis of the image data stored in the image data editing memory 730.

The development voltage controller 760 may so perform a control as to apply a development voltage to the developing rollers 6, i.e., the developing rollers 6K, 6Y, 6M, and 6C, and thereby develop the toners on the electrostatic latent images formed on the respective surfaces of the photosensitive drums 4, i.e., the photosensitive drums 4K, 4Y, 4M, and 4C, in response to the instruction given by the print controller 700.

The transfer voltage controller 770 may so perform a control as to apply a transfer voltage to the transfer rollers 10, i.e., the transfer rollers 10K, 10Y, 10M, and 10C, and thereby transfer the toner images onto the recording medium, in response to the instruction given by the print controller 700.

The image formation driving controller 780 may perform a driving control of respective driving motors 781 to 784, in response to the instruction given by the print controller 700. The driving motors 781 to 784 may perform rotation driving of the photosensitive drums 4, the charging rollers 5, and the developing rollers 6. Specifically, the driving motors 781 to 784 may perform rotation driving of the photosensitive drums 4K, 4Y, 4M, and 4C, the charging rollers 5K, 5Y, 5M, and 5C, and the developing rollers 6K, 6Y, 6M, and 6C, respectively.

The fixing controller 790 may control the fixing operation of the fixing device 105, in response to the instruction given by the print controller 700. Specifically, the fixing controller 790 may perform a control of a voltage to be applied to the heater unit 791. The fixing controller 790 may perform an ON-OFF control of the voltage to be applied to the heater unit 791, on the basis of the temperature of the fixing device 105 measured by the thermistor 792. The fixing controller 790 may further perform an operation control of the fixing motor 793, an operation control of the cam motor 794, and any other control, for example.

The conveyance belt driving controller 800 may perform an operation control of the conveyance belt motor 801 provided in the image forming apparatus 1, in response to the instruction given by the print controller 700. The conveyance belt motor 801 may perform driving of the conveyance belt 18.

The medium-feeding and conveyance driving controller 810 may perform an operation control of a medium feeding motor 811 and a conveying motor 812 that are provided in the image forming apparatus 1, in response to the instruction given by the print controller 700.

[Configuration of Fixing Device 105]

Figure 2A:
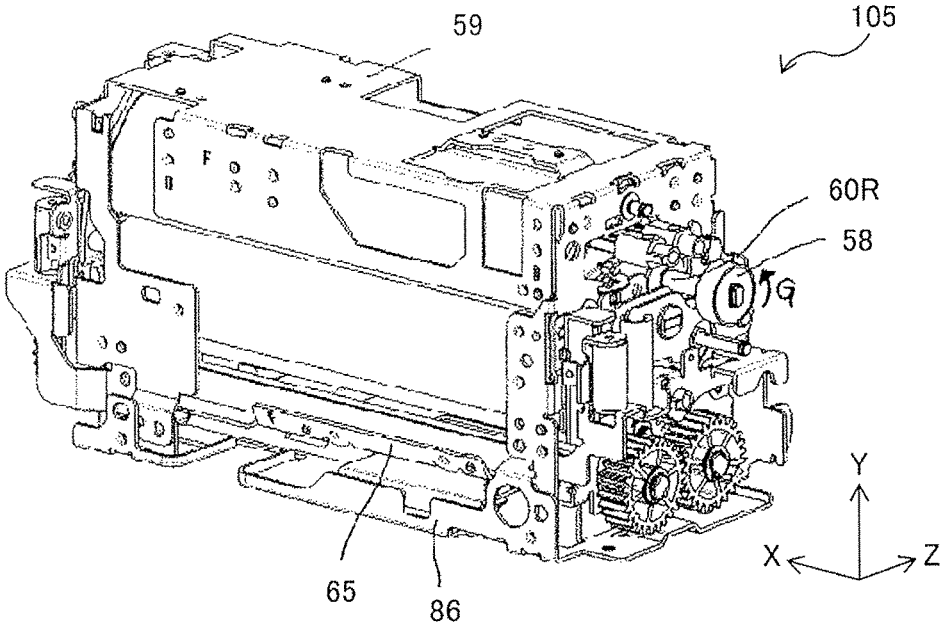
FIG. 2A is an enlarged perspective view of the example of an appearance of a fixing device illustrated in FIG. 1A.
Figure 2B:
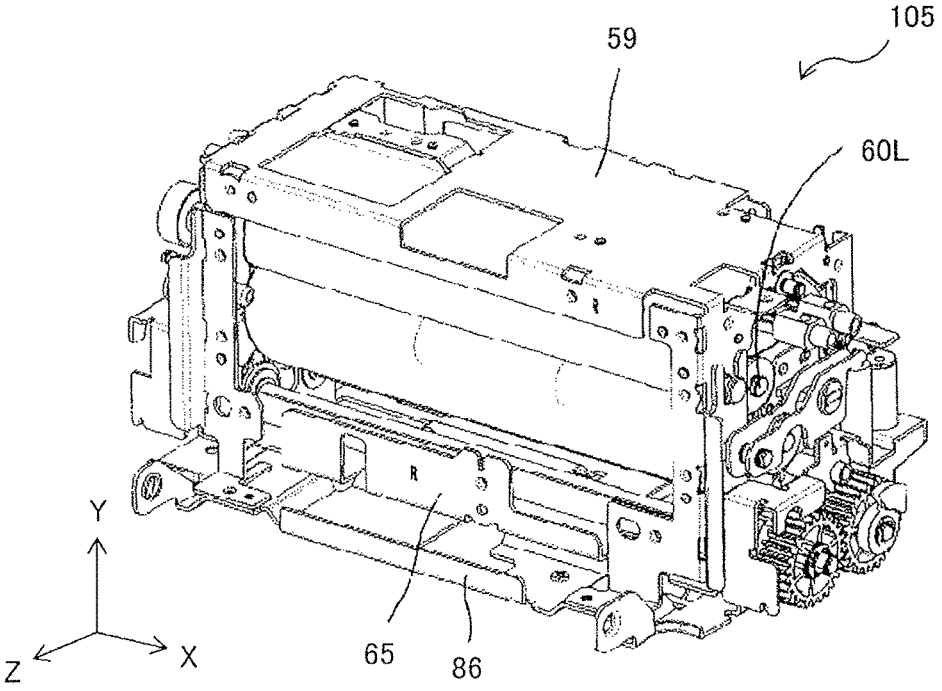
FIG. 2B is an enlarged perspective view of an example of the appearance of the fixing device illustrated in FIG. 2A.
Figure 3A:
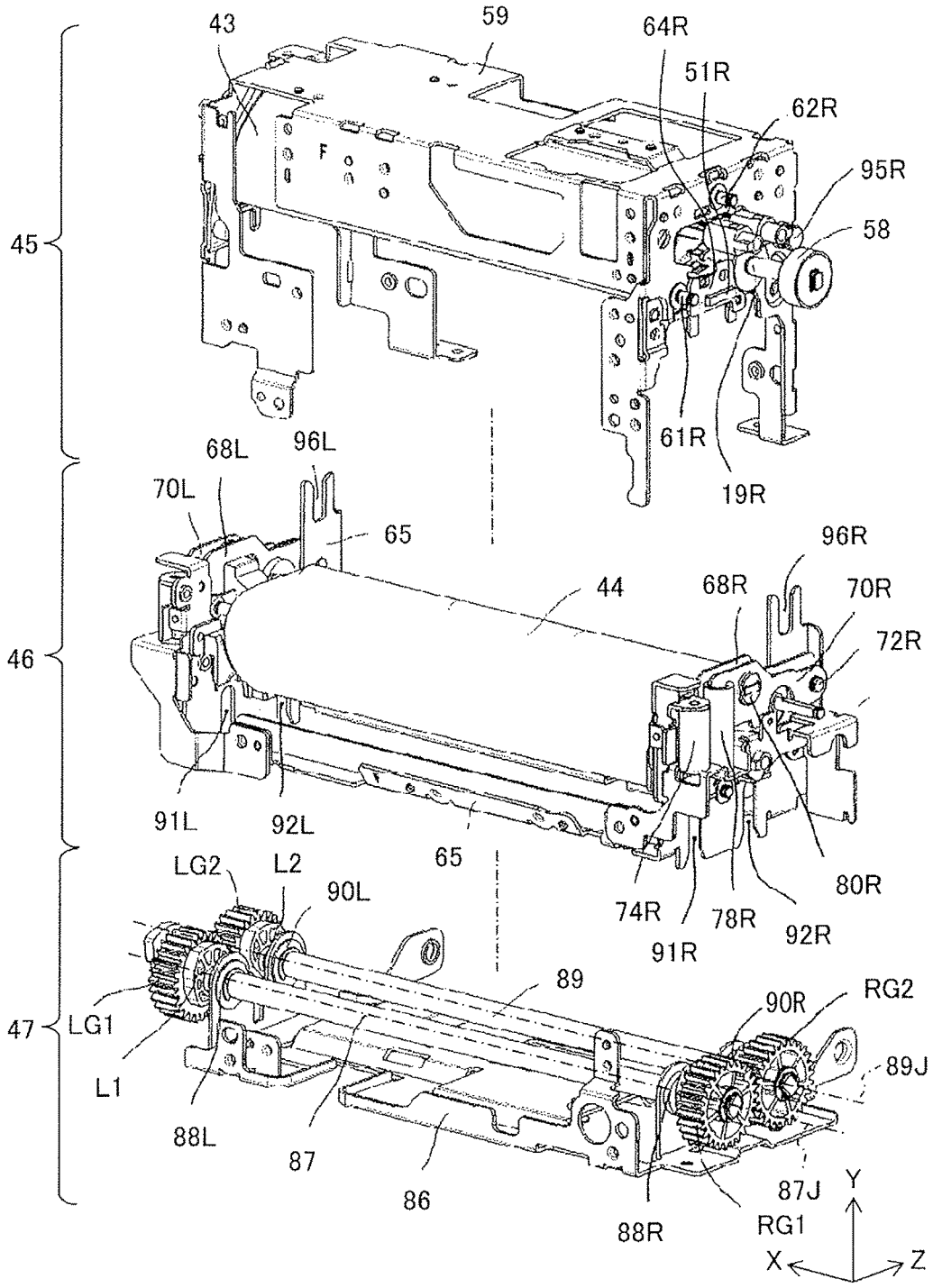
FIG. 3A is an exploded perspective view of the fixing device illustrated in FIG. 2A.
Figure 3B:
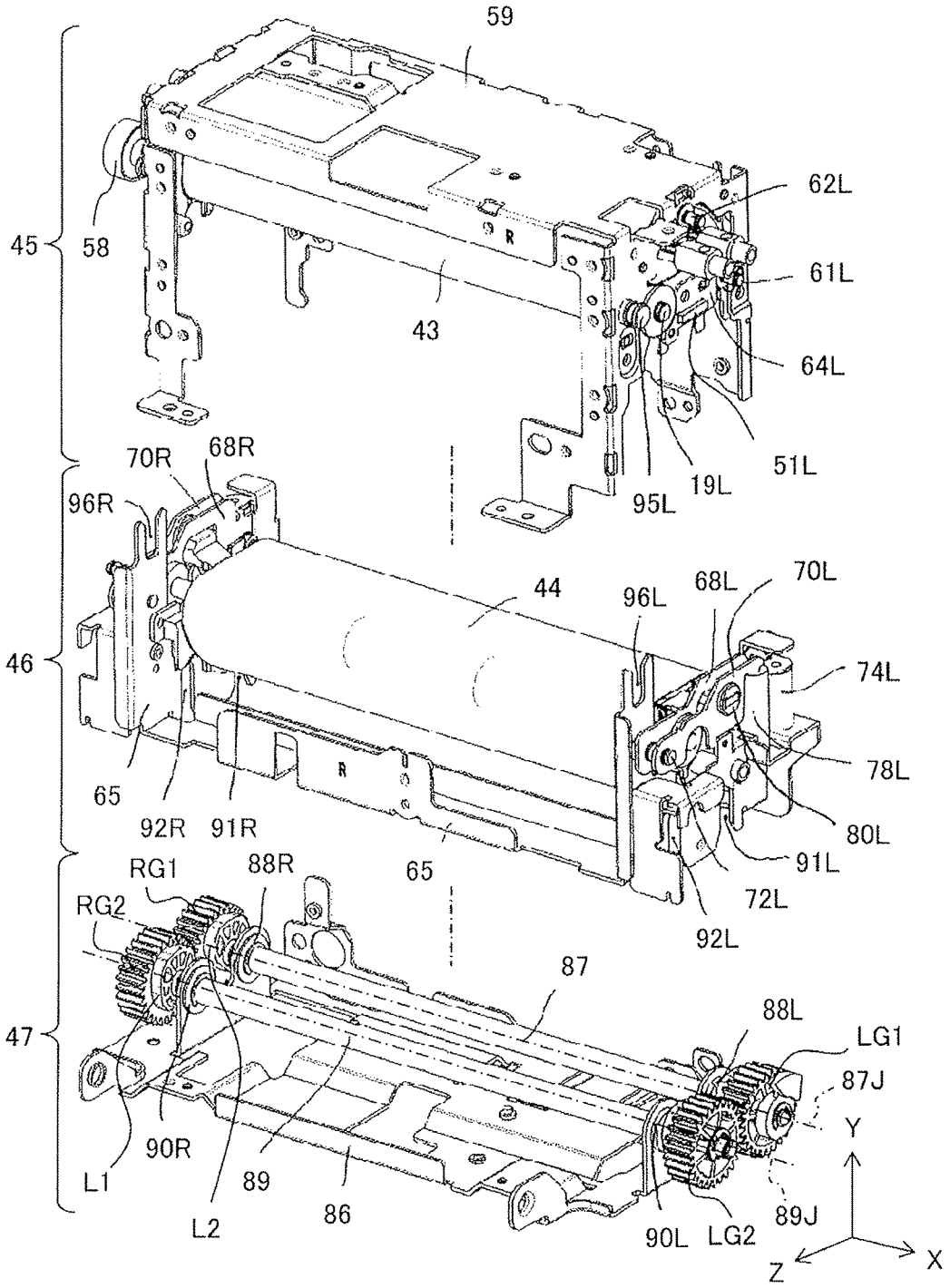
FIG. 3B is an exploded perspective view of the fixing device illustrated in FIG. 2B.
Figure 4:
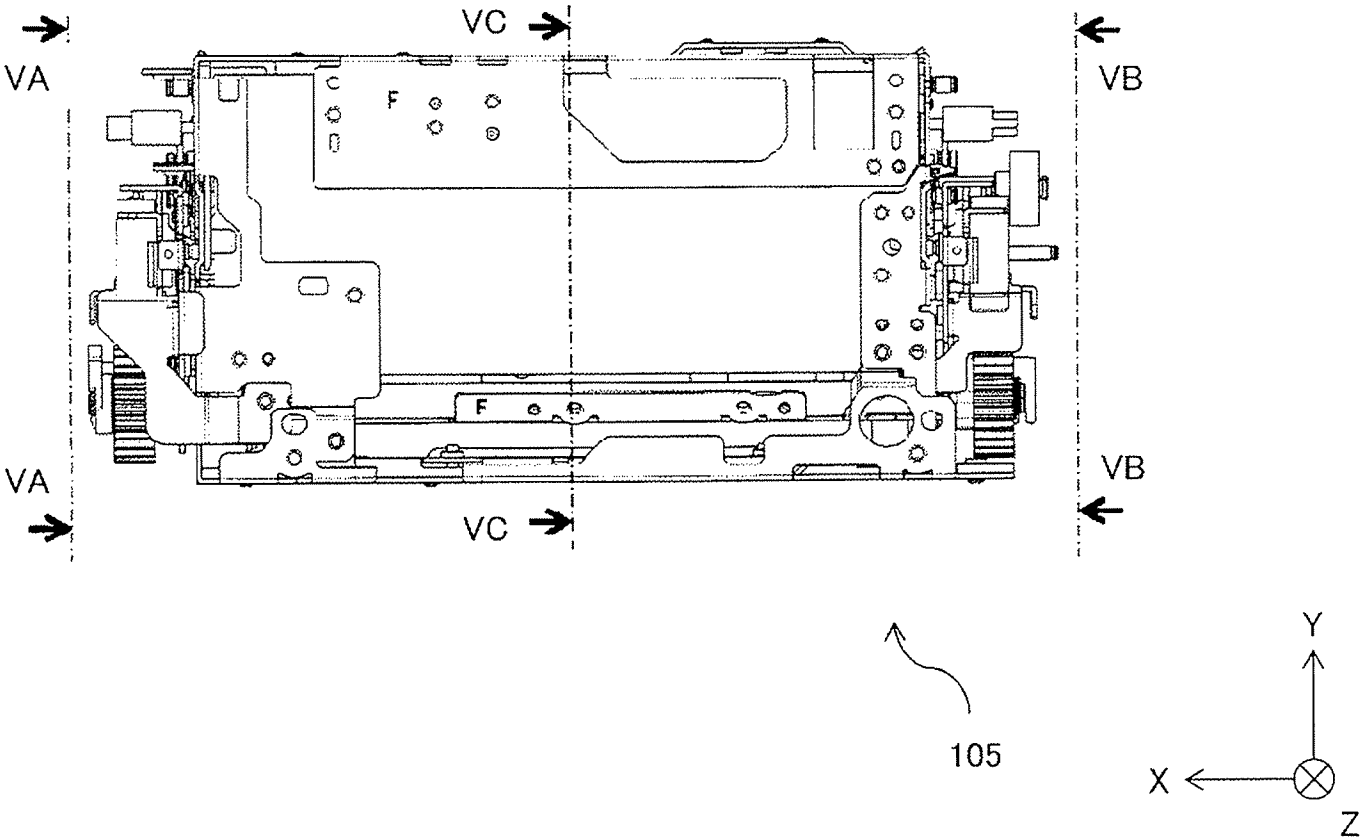
FIG. 4 is a front view of an example of the appearance of the fixing device illustrated in FIG. 1A.
Figure 5A:
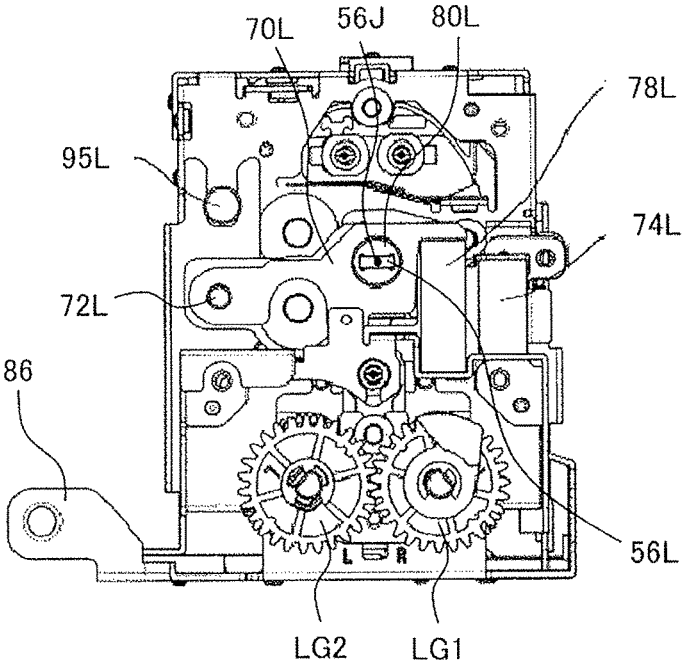
FIG. 5A is a cross-sectional view of the fixing device taken along a line VA-VA illustrated in FIG. 4.
Figure 5B:
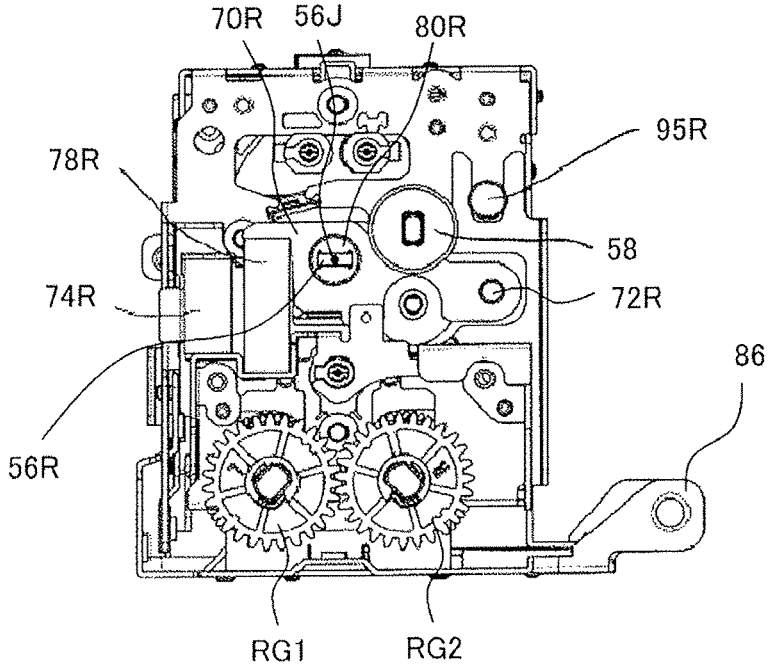
FIG. 5B is a cross-sectional view of the fixing device taken along a line VB-VB illustrated in FIG. 4.
Figure 5C:
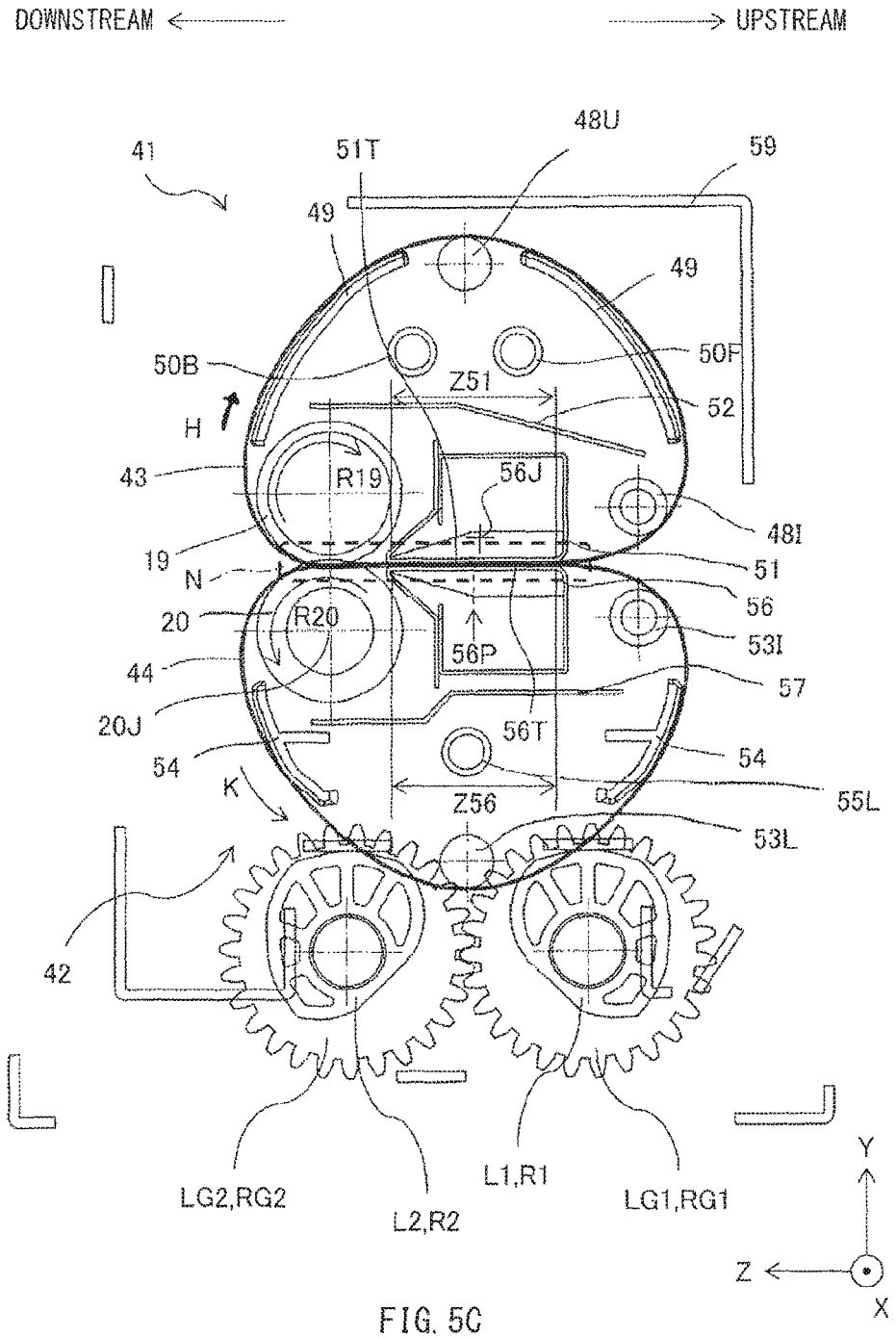
FIG. 5C is a cross-sectional view of the fixing device taken along a line VC-VC illustrated in FIG. 4.
Figure 6A:
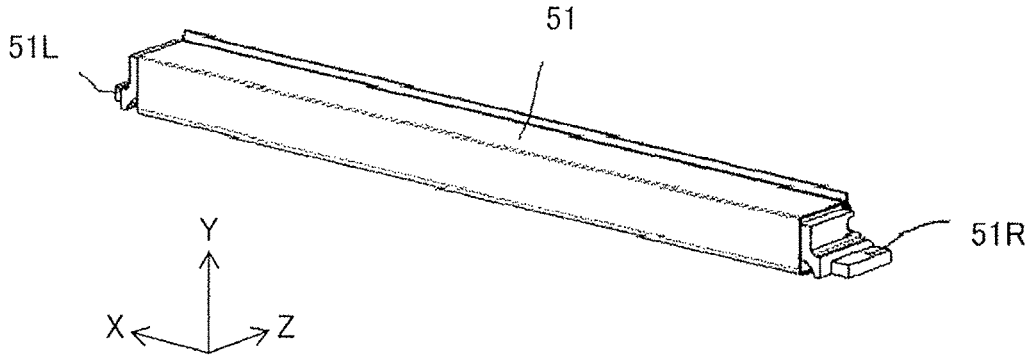
FIG. 6A is a perspective view of an example of an appearance of part of members in the fixing device illustrated in FIG. 4.
Figure 6B:
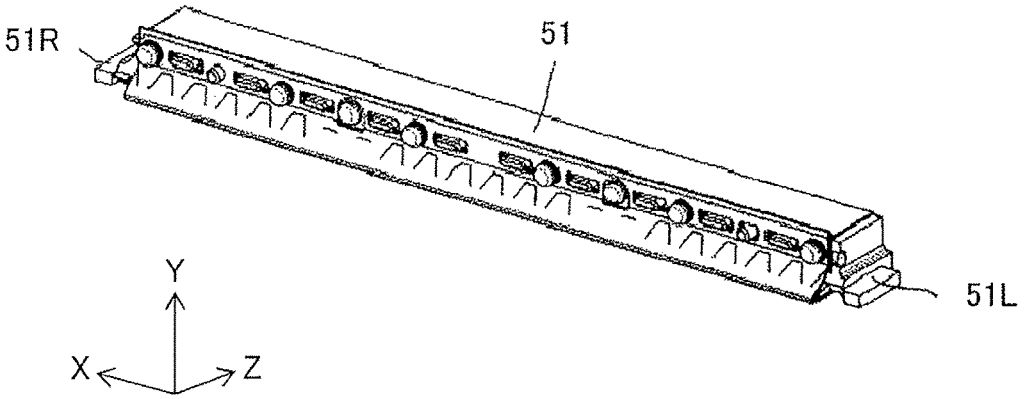
FIG. 6B is another perspective view of the example of the appearance of part of the members in the fixing device illustrated in FIG. 4.
Figure 7A:
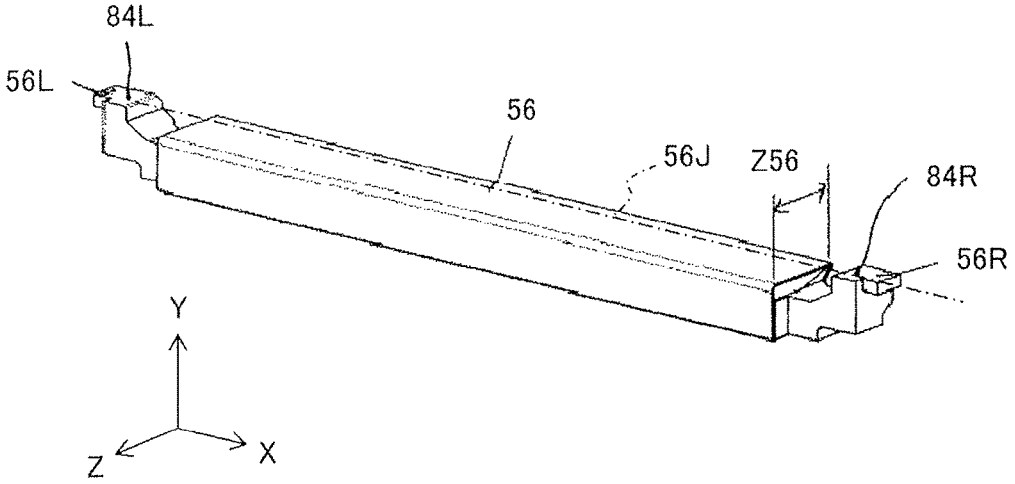
FIG. 7A is a perspective view of an example of an appearance of another part of the members in the fixing device illustrated in FIG. 4.
Figure 7B:
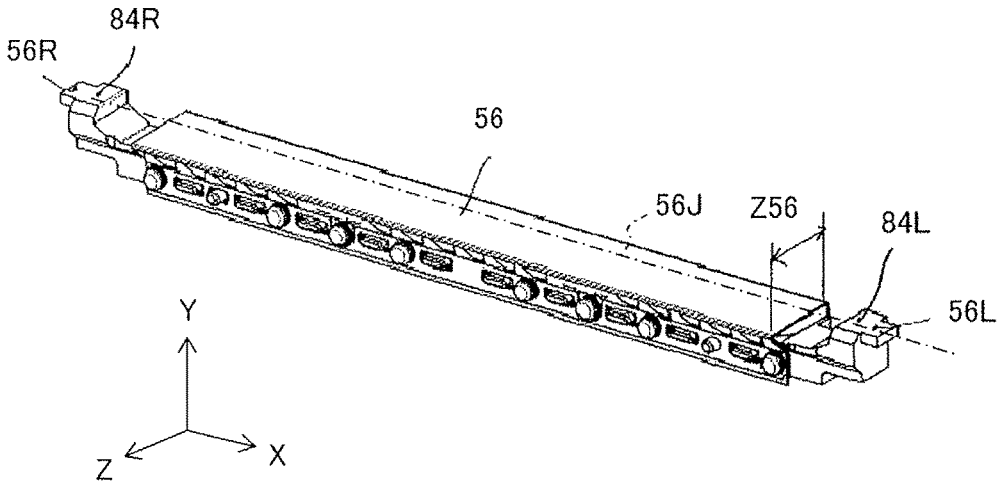
FIG. 7B is a perspective view of the example of the appearance of the another part of the members in the fixing device illustrated in FIG. 4.

A description is given below of a detailed configuration of the fixing device 105 with reference to FIGS. 2A to 12B. FIG. 2A is a perspective view of an appearance of the fixing device 105 viewed from the upstream in the conveyance direction of the recording medium. FIG. 2B is a perspective view of the appearance of the fixing device 105 viewed from the downstream in the conveyance direction of the recording medium. FIG. 3A is an exploded perspective view of the fixing device 105 corresponding to FIG. 2A. FIG. 3B is an exploded perspective view of the fixing device 105 corresponding to FIG. 2B. FIG. 4 is a front view of the fixing device 105 viewed from the upstream in the conveyance direction of the recording medium. FIGS. 5A to 5C are cross-sectional views of the fixing device 105 taken along lines VA-VA, VB-VB, and VC-VC illustrated in FIG. 4, respectively. FIGS. 6A and 6B are each a perspective view of an appearance of a fixing pad 51 which will be described later in greater detail. FIGS. 7A and 7B are each a perspective view of an appearance of a pressure applying pad 56.

For example, referring to FIGS. 3A and 3B, the fixing device 105 may include an upper unit 45, an intermediate unit 46, and a lower unit 47 that are located on upper side, in the middle, and on lower side, respectively, in the Y-axis direction that is orthogonal to the Z-axis direction corresponding to the conveyance direction of the recording medium. The intermediate unit 46 may be sandwiched between the upper unit 45 and the lower unit 47 in the Y-axis direction, and may be held by the upper unit 45 and the lower unit 47 in a manner in which the intermediate unit 46 is movable in the Y-axis direction between the upper unit 45 and the lower unit 47. The intermediate unit 46, the upper unit 45, and the lower unit 47 may correspond to a "first unit", a "second unit", and a "third unit" in one specific but non-limiting embodiment of the technology.

[Upper Unit 45]

The upper unit 45 may face the intermediate unit 46 in the Y-axis direction. Referring to FIG. 5C, the upper unit 45 may include an upper chassis 59 and a fixing unit 41 provided in the upper chassis 59. The upper chassis 59 may correspond to a "second base" in one specific but non-limiting embodiment of the technology. The fixing unit 41 may include a fixing belt 43, a fixing roller 19, the fixing pad 51, guiding rollers 48I and 48U, two guiding members 49, heaters 50B and 50F, and a reflector 52, for example.

The fixing belt 43 may be an endless elastic belt including a resin material such as polyimide resin, or an endless elastic belt including a metal base material on which a material such as silicone rubber is provided, for example. The metal base material may include metal such as stainless steel, for example. The fixing belt 43 may lie on the members such as the fixing roller 19, the guiding rollers 48I and 48U, and the guiding member 49, while being stretched. The fixing belt 43 may be thereby rotated circularly in a direction indicated by an arrow H in FIG. 5C. The fixing belt 43 may come into contact with a pressure applying belt 44 at a position facing a pressure applying unit 42, and thereby form a nip portion N that expands on the X-Z plane as illustrated in FIG. 5C. The pressure applying unit 42 and the pressure applying belt 44 will be described later in greater detail. The fixing belt 43 may travel in the +Z direction in the vicinity of the nip portion N. The fixing roller 19, the fixing pad 51, the guiding rollers 48I and 48U, the guiding members 49, the heaters 50B and 50F, and the reflector 52 may each be disposed in space surrounded by the fixing belt 43. The fixing belt 43 may correspond to a "second belt" that may serve as a "moving member" in one specific but non-limiting embodiment of the technology.

The fixing roller 19 may be in contact with an internal surface of the fixing belt 43. Further, the fixing roller 19 may be rotatable in a direction indicated by an arrow R19, for example. In other words, the fixing roller 19 may drive the fixing belt 43 to rotate in the direction indicated by the arrow H by rotating in the direction indicated by the arrow R19. When the fixing device 105 is in operation, the fixing roller 19 may face a pressure applying roller 20 with the fixing belt 43 and the pressure applying belt 44 in between. The fixing roller 19 may be a columnar or cylindrical rotating member that extends in the X-axis direction. The fixing roller 19 may have rotation axis ends 19L and 19R at its respective ends in the X-axis direction. Each of the rotation axis ends 19L and 19R of the fixing roller 19 may be held in a freely-rotatable manner relative to the upper chassis 59. The fixing roller 19 may be rotated by driving force that is transmitted from the fixing motor 793 illustrated in FIG. 1B via a driving gear 58. The driving gear 58 may be attached to the rotation axis end 19R. The fixing roller 19 may correspond to a "second rotating member" in one specific but non-limiting embodiment of the technology.

Referring to FIGS. 6A and 6B, the fixing pad 51 may be a prismatic member that extends in the X-axis direction, for example. The fixing pad 51 may be so disposed as to press the fixing belt 43 toward the pressure applying unit 42 in the intermediate unit 46, i.e., in the −Y direction. The fixing pad 51 may include a flat part 51T that extends in the X-axis direction as illustrated in FIG. 5C. When the fixing device 105 is in operation, the flat part 51T of the fixing pad 51 may face a flat part 56T of the pressure applying pad 56 with the fixing belt 43 and the pressure applying belt 44 in between. The flat part 56T will be described later in greater detail. The fixing pad 51 may have projections 51L and 51R at its respective ends in the X-axis direction as illustrated in FIGS. 6A and 6B. Each of the projections 51L and 51R may be fixed to the upper chassis 59 with holding metal plates 64L and 64R in between, respectively, as illustrated in FIGS. 3A and 3B.

The guiding roller 48I may be a columnar or cylindrical rotating member that extends in the X-axis direction. The guiding roller 48I may have rotation axis ends 61L and 61R at its respective ends in the X-axis direction. Each of the rotation axis ends 61L and 61R may be held in a freely-rotatable manner relative to the upper chassis 59. Similarly, the guiding roller 48U may be a columnar or cylindrical rotating member that extends in the X-axis direction. The guiding roller 48U may have rotation axis ends 62L and 62R at its respective ends in the X-axis direction. Each of the rotation axis ends 62L and 62R may be held in a freely-rotatable manner relative to the upper chassis 59.

The two guiding members 49 may guide a path along which the fixing belt 43 rotates circularly. The two guiding members 49 may be fixed to the upper chassis 59.

Each of the heaters 50B and 50F may include a heat generator that generates heat for applying heat to the fixing belt 43. The reflector 52 may reflect the heat generated by the heaters 50B and 50F toward a part, of the internal surface of the fixing belt 43, that is located on opposite side to the fixing roller 19 and the fixing pad 51. The heaters 50B and 50F and the reflector 52 may be also fixed to the upper chassis 59.

[Intermediate Unit 46]

Figure 8A:
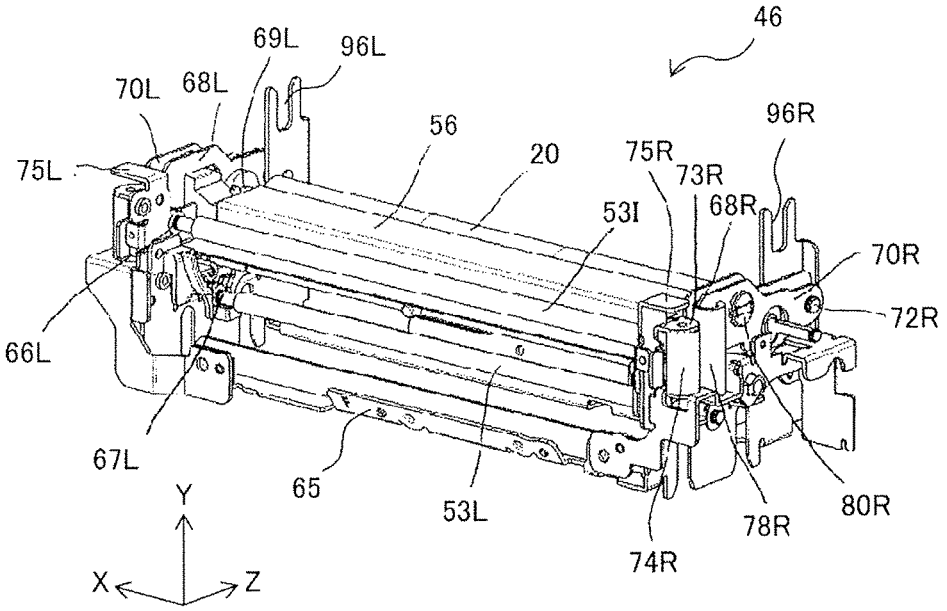
FIG. 8A is a perspective view of an example of an appearance of an intermediate unit of the fixing device illustrated in FIG. 4.
Figure 8B:
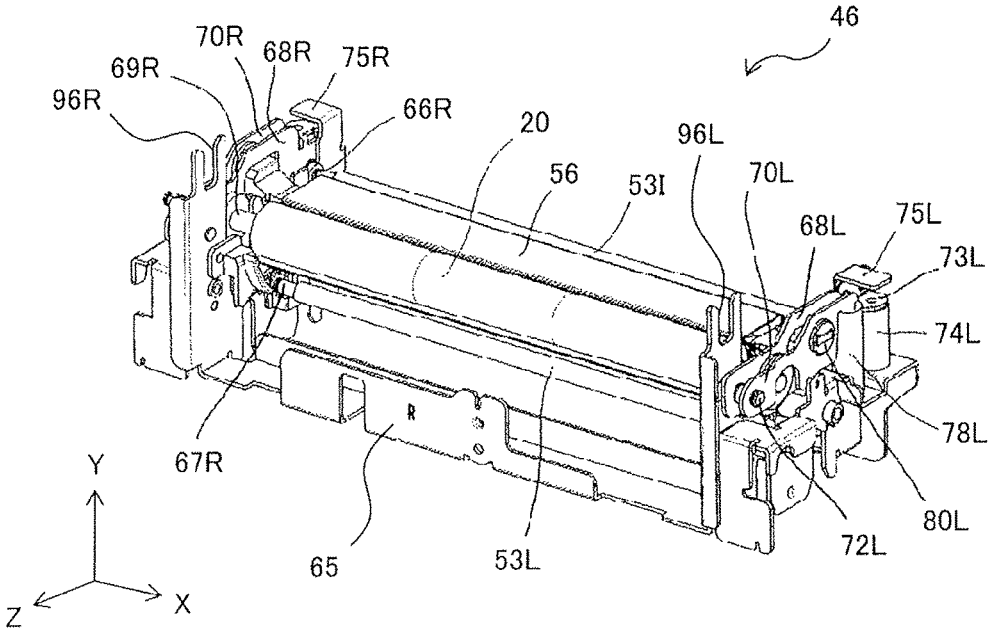
FIG. 8B is another perspective view of the example of the appearance of the intermediate unit of the fixing device illustrated in FIG. 4.
Figure 9A:
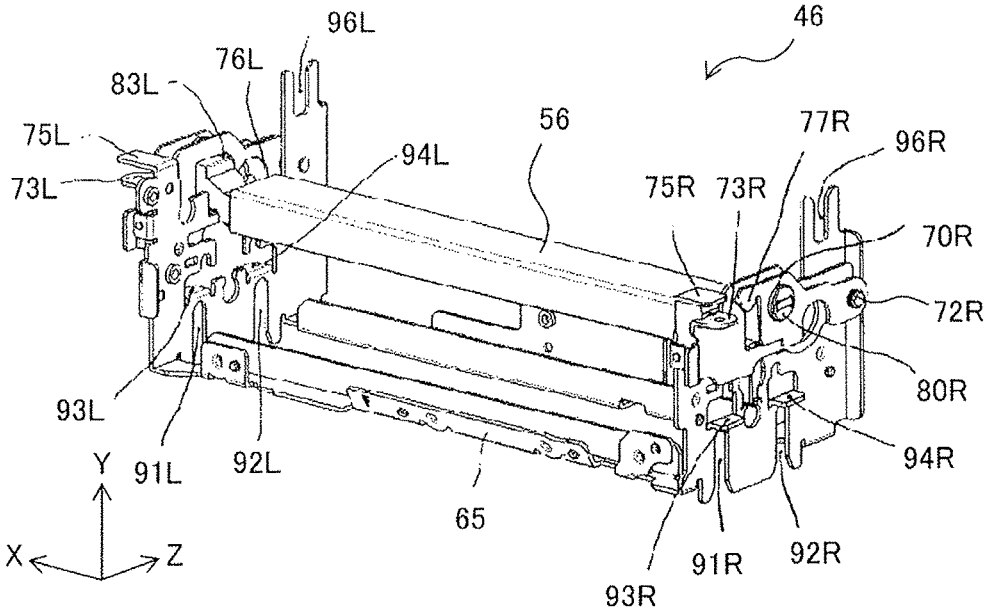
FIG. 9A is a perspective view of an example of part of components of the intermediate unit illustrated in FIG. 8A.
Figure 9B:
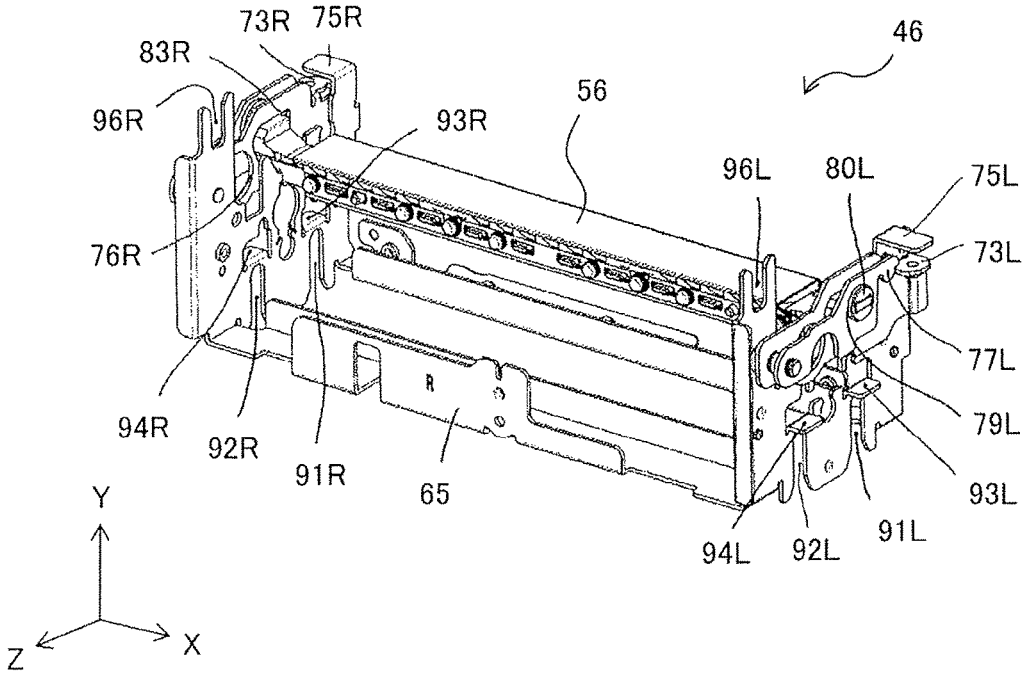
FIG. 9B is a perspective view of an example of part of components of the intermediate unit illustrated in FIG. 8B.

The intermediate unit 46 may face the upper unit 45 in the Y-axis direction. Referring to FIG. 5C, the intermediate unit 46 may include an intermediate chassis 65 and the pressure applying unit 42 provided in the intermediate chassis 65. The intermediate chassis 65 may correspond to a "first base" in one specific but non-limiting embodiment of the technology. The pressure applying unit 42 may include the pressure applying belt 44, the pressure applying roller 20, the pressure applying pad 56, guiding rollers 53I and 53L, two guiding members 54, the heater 55L, and a reflector 57, for example. FIGS. 8A and 8B each illustrate an appearance of the intermediate unit 46, omitting illustration of the pressure applying belt 44 and the guiding members 54 for easier understanding of an internal structure of the intermediate unit 46. FIGS. 9A and 9B each illustrate the appearance of the intermediate unit 46, further omitting illustration of the pressure applying roller 20 and the guiding rollers 53I and 53L.

The pressure applying belt 44 may be an endless elastic belt including a resin material such as polyimide resin, or an endless elastic belt including a metal base material on which a material such as silicone rubber is provided, for example. The metal base material may include metal such as stainless steel, for example. The pressure applying belt 44 may lie on the members such as the pressure applying roller 20, the guiding rollers 53I and 53L, and the guiding member 54, while being stretched. The pressure applying belt 44 may be thereby rotated circularly in a direction indicated by an arrow K in FIG. 5C. The pressure applying belt 44 may be brought into contact with the fixing belt 43 at a position facing the fixing unit 41, and thereby form the nip portion N that expands on the X-Z plane as illustrated in FIG. 5C. The pressure applying belt 44 may travel in the +Z direction in the vicinity of the nip portion N, as with the fixing belt 43. The pressure applying roller 20, the pressure applying pad 56, the guiding rollers 53I and 53L, the guiding members 54, the heater 55L, and the reflector 57 may each be disposed in space surrounded by the pressure applying belt 44. The pressure applying belt 44 may correspond to a "first belt" in one specific but non-limiting embodiment of the technology.

The pressure applying roller 20 may be in contact with an internal surface of the pressure applying belt 44. Further, the pressure applying roller 20 may be rotatable in a direction indicated by an arrow R20, for example. The pressure applying roller 20 may be driven to be rotated in accordance with the fixing belt 43, together with the pressure applying belt 44. The pressure applying roller 20 may be a columnar or cylindrical rotating member that extends in the X-axis direction. The pressure applying roller 20 may be supported at its both ends by a holding part 76L of a holding arm 68L and a holding part 76R of a holding arm 68R, in a manner in which the pressure applying roller 20 is freely rotatable around a rotation shaft 20J, as illustrated in FIGS. 8A and 8B. The holding arms 68L and 68R may be held in a manner in which the holding arms 68L and 68R are freely rotatable relative to the intermediate chassis 65 around rotation shafts 72L and 72R, respectively. The rotation shafts 72L and 72R may be provided in the intermediate chassis 65. This may allow the position of the pressure applying roller 20 relative to the pressure applying belt 44 to be variable. Each of the rotation shafts 72L and 72R may be a projection that has a substantially-columnar appearance that extends in the X-axis direction. The rotation shaft 72L may be located at a position that is on the extension of the rotation shaft 72R in the X-axis direction. The pressure applying roller 20 may correspond to a "first rotating member" in one specific but non-limiting embodiment of the technology. The holding arms 68L and 68R may correspond to a "first rotating member support" in one specific but non-limiting embodiment of the technology.

Referring to FIGS. 7A and 7B, the pressure applying pad 56 may be a prismatic member that extends in the X-axis direction, for example. The pressure applying pad 56 may be so disposed as to press the pressure applying belt 44 toward the fixing unit 41 in the upper unit 45, i.e., in the +Y direction. The pressure applying pad 56 may correspond to a "first pressing member" in one specific but non-limiting embodiment of the technology. The pressure applying pad 56 may include the flat part 56T that extends in the X-axis direction as illustrated in FIG. 5C. When the fixing device 105 is in operation, the flat part 56T of the pressure applying pad 56 may face the flat part 51T of the fixing pad 51 with the fixing belt 43 and the pressure applying belt 44 in between. The pressure applying pad 56 may be held in a manner in which the pressure applying pad 56 is rotatable relative to the holding arms 70L and 70R around a rotation axis 56J along the X-axis. The X-axis may be substantially orthogonal to both the Z-axis direction and the Y-axis direction. Specifically, the pressure applying pad 56 may have projections 56L and 56R at its respective ends in the X-axis direction as illustrated in FIGS. 7A and 7B. The projections 56L and 56R may be held by the holding arms 70L and 70R with bearings 80L and 80R in between, respectively, in a manner in which the projections 56L and 56R are freely rotatable around the rotation axis 56J. More specifically, the projections 56L and 56R may be fit into the bearings 80L and 80R, respectively. The bearings 80L and 80R may be inserted through openings provided in the holding arms 70L and 70R, and thereby held by the holding arms 70L and 70R in a manner in which the bearings 80L and 80R are freely rotatable around the rotation axis 56J, respectively. Further, the holding arms 70L and 70R may be held in a manner in which the holding arms 70L and 70R are freely rotatable relative to the intermediate chassis 65 around the rotation shafts 72L and 72R provided in the intermediate chassis 65. Hence, the holding arms 70L and 70R that hold the pressure applying pad 56 and the holding arms 68L and 68R that hold the pressure applying roller 20 may be adjacent to each other in the X-axis direction, and pivotable around the same rotation shafts 72L and 72R in the Y-Z plane, respectively. Further, the projections 56L and 56R may include contact surfaces 84L and 84R that come into contact with edges 97L and 97R of through holes 83L and 83R which will be described later in greater detail, respectively.

The rotation axis 56J may correspond to a "rotation axis" in one specific but non-limiting embodiment of the technology. The holding arms 70L and 70R may correspond to a "first pressing member support" in one specific but non-limiting embodiment of the technology. The rotation shafts 72L and 72R may correspond to a "shaft" in one specific but non-limiting embodiment of the technology.

The rotation axis 56J (the center of the bearings 80L and 80R) may be preferably located at a position that is coincident with a center position 56P of the flat part 56T of the pressure applying pad 56 in the Z-axis direction, or at a position that is downstream of the center position 56P, as illustrated in FIG. 5C. One reason for this is that, when the mode of the fixing operation described later is switched from the separated mode to the regular pressure mode or the reduced pressure mode, the foregoing position of the rotation axis 56J allows for prompt variation, in attitude of the flat part 56T of the pressure applying pad 56 relative to the flat part 51T of the fixing pad 51, that causes the attitude of the flat part 56T to be closer to a parallel state. This may in turn reduce variation in nip pressure in accordance with the variation in attitude of the flat part 56T. Accordingly, it is easier to achieve a more stable nip pressure. Further, it may be considered that greater nip pressure is achieved by locating the rotation axis 56J (the center of the bearings 80L and 80R) at the position that is downstream of the center position 56P. Moreover, the pressure applying pad 56 may preferably have a dimension Z56 in the Z-axis direction that is greater than a dimension Z51 of the fixing pad 51 in the Z-axis direction. One reason for this is that more-stable nip pressure is achieved more easily owing to an increase in length of the nip portion N in the Z-axis direction.

Referring to FIGS. 8A and 8B, the guiding roller 53I may be a columnar or cylindrical rotating member that extends in the X-axis direction. The guiding roller 53I may have rotation axis ends 66L and 66R at its respective ends. Each of the rotation axis ends 66L and 66R may be held in a freely-rotatable manner relative to the intermediate chassis 65. Similarly, as illustrated in FIGS. 8A and 8B, the guiding roller 53L may be a columnar or cylindrical rotating member that extends in the X-axis direction. The guiding roller 53L may have rotation axis ends 67L and 67R at its respective ends as illustrated in FIGS. 8A and 8B. Each of the rotation axis ends 67L and 67R may be held in a freely-rotatable manner relative to the intermediate chassis 65.

The two guiding members 54 may guide a path along which the pressure applying belt 44 rotates circularly. The two guiding members 54 may be fixed to the intermediate chassis 65, for example.

The heater 55L may include a heat generator that generates heat directed to heating of the pressure applying belt 44. The reflector 57 may reflect the heat generated by the heater 55L toward a part, of the internal surface of the pressure applying belt 44, that is located on opposite side to the pressure applying roller 20 and the pressure applying pad 56. The presence of the reflector 57 may allow the heat generated by the heater 55L to be effectively transmitted to the pressure applying belt 44. The heater 55L and the reflector 57 may be also fixed to the intermediate chassis 65.

The intermediate unit 46 may further include first biasing members 74L and 74R and second biasing members 78L and 78R. The first biasing member 74L may have one end that comes into contact with a stopper 73L which is part of the holding arm 68L, and have the other end that comes into contact with part of the intermediate chassis 65. The first biasing member 74R may have one end that comes into contact with a stopper 73R which is part of the holding arm 68R, and have the other end that comes into contact with part of the intermediate chassis 65. The first biasing members 74L and 74R may bias the stoppers 73L and 73R in a direction in which the stoppers 73L and 73R are away from the intermediate chassis 65, respectively. In other words, the first biasing members 74L and 74R may so bias the holding arms 68L and 68R, respectively, upward that the pressure applying roller 20 is brought closer to the upper unit 45 in the Y-axis direction. The second biasing member 78L may have one end that comes into contact with a fixation part 77L of the holding arm 70L, and have the other end that is brought into contact with part of the intermediate chassis 65. The fixation part 77L may be located at an end, of the holding arm 70L, on the opposite side to the rotation shaft 72L, as illustrated in FIGS. 9A and 9B. The second biasing member 78R may have one end that comes into contact with a fixation part 77R of the holding arm 70R, and have the other end that comes into contact with part of the intermediate chassis 65. The fixation part 77R may be located at an end, of the holding arm 70R, on the opposite side to the rotation shaft 72R, as illustrated in FIGS. 9A and 9B. The second biasing members 78L and 78R may bias the ends, of the holding arms 70L and 70R, provided with the fixation parts 77L and 77R in a direction in which the ends of the holding arms 70L and 70R are away from the intermediate chassis 65, respectively. In other words, the second biasing members 78L and 78R may so bias the holding arms 70L and 70R, respectively, upward that the pressure applying pad 56 is brought closer to the upper unit 45 in the Y-axis direction. Each of the first biasing members 74L and 74R and the second biasing members 78L and 78R may include a coil spring, for example.

The intermediate unit 46 may further include movement limiting parts 75L and 75R that limit the movement of the holding arms 68L and 68R toward the upper unit 45, respectively. The movement limiting parts 75L and 75R may be so provided on the intermediate chassis 65 as to stop the pivoting movement of the holding arms 68L and 68R by being brought into contact with the stoppers 73L and 73R, respectively.

Referring to FIGS. 13B, 14B, 15B, and 16B, the holding arms 68L and 68R may have the through holes 83L and 83R having the edges 97L and 97R, respectively. The projections 56L and 56R of the pressure applying pad 56 may pass through the through holes 83L and 83R, respectively. The holding arms 70L and 70R may be limited in the movement toward the upper unit 45, by coming into contact with the edges 97L and 97R of the holding arms 68L and 68R, respectively.

[Lower Unit 47]

Figure 10:
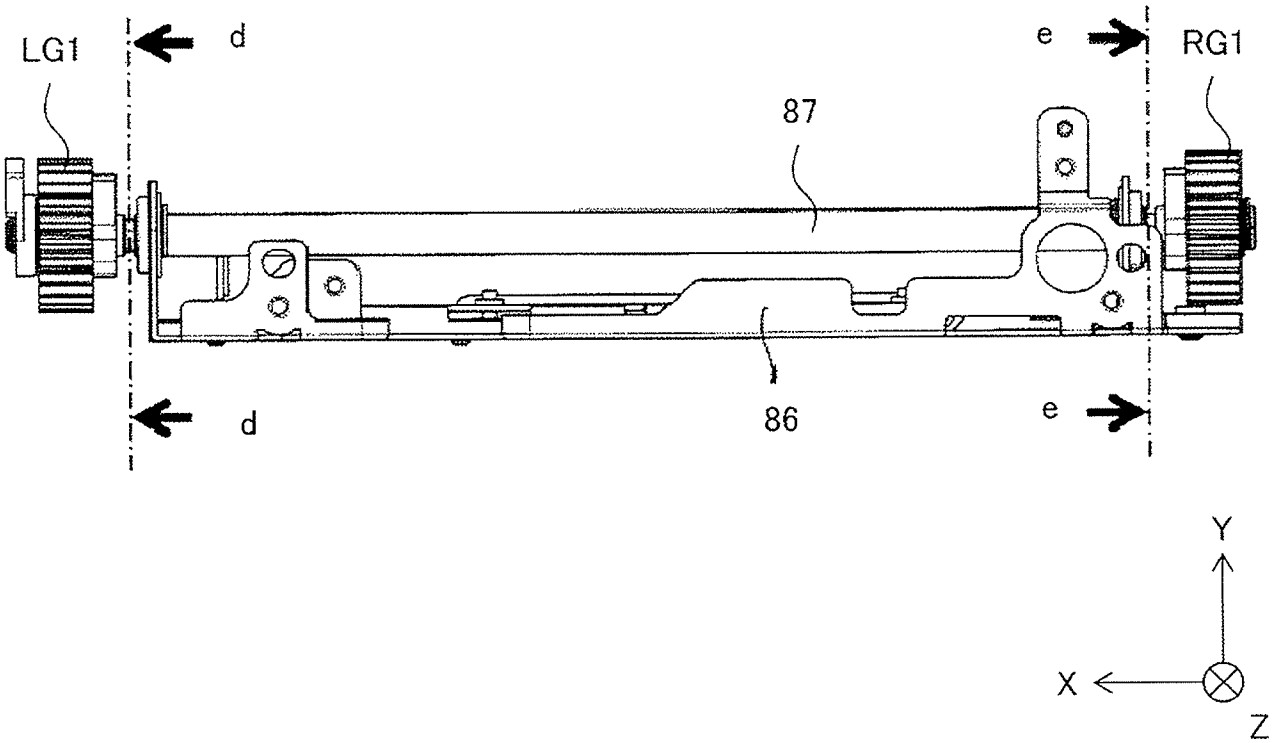
FIG. 10 is a front view of an example of an appearance of a lower unit illustrated in FIG. 3A.
Figure 11A:
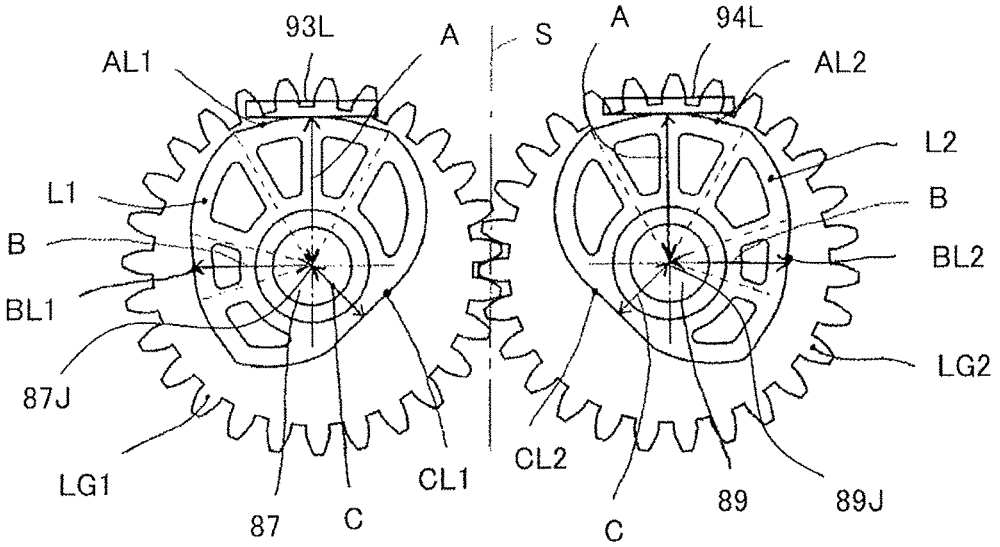
FIG. 11A is a side view, from a direction indicated by an arrow "d", of an example of part of the fixing device illustrated in FIG. 10 in a regular pressure state.
Figure 11B:
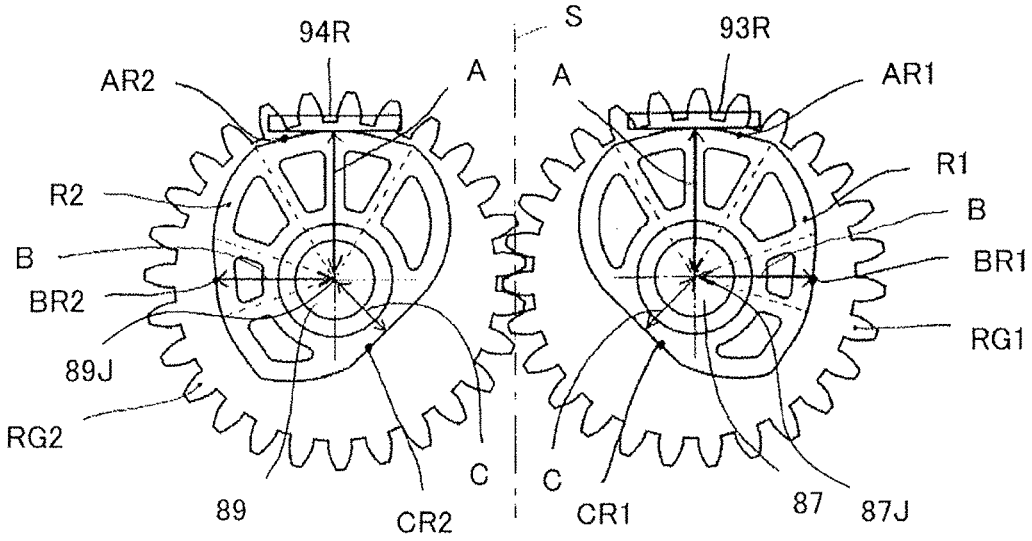
FIG. 11B is a side view, from a direction indicated by an arrow "e", of the example of part of the fixing device illustrated in FIG. 10 in the regular pressure state.
Figure 12A:
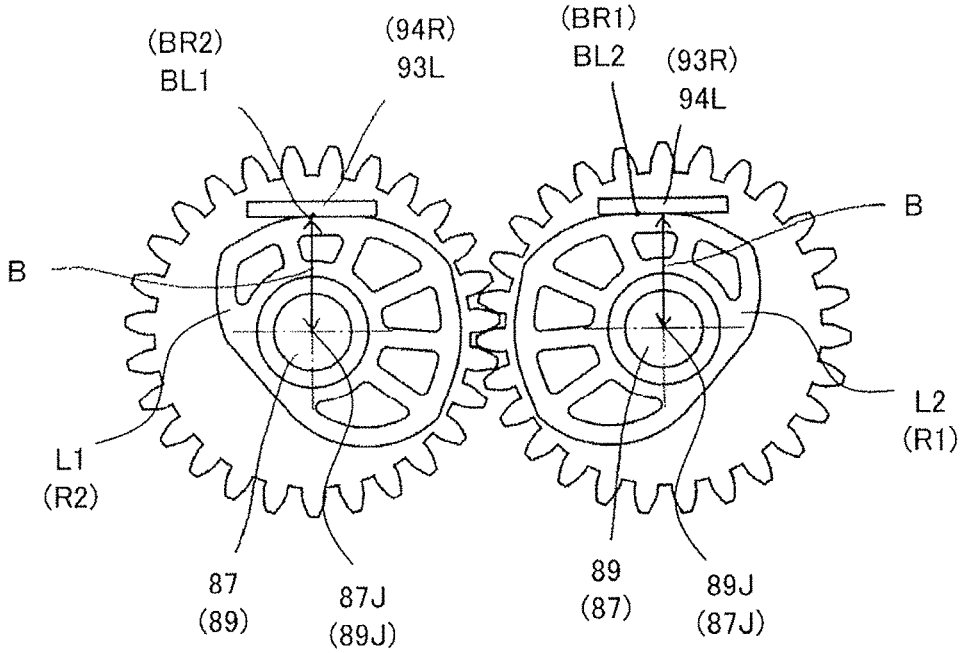
FIG. 12A is a side view, from the direction indicated by the arrow "d", of an example of part of the fixing device illustrated in FIG. 10 in a reduced pressure state.
Figure 12B:
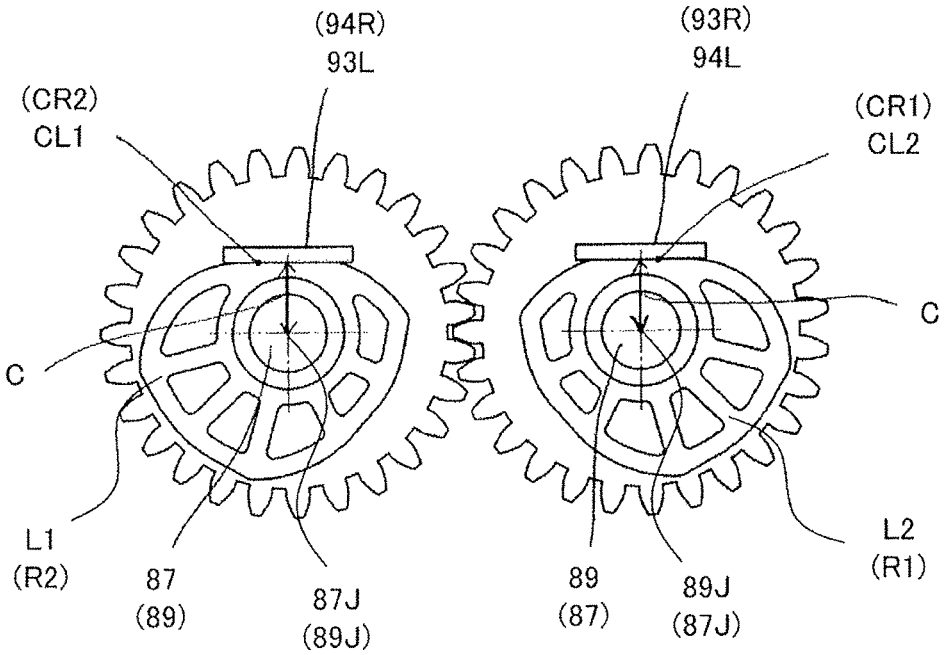
FIG. 12B is a side view, from the direction indicated by the arrow "d", of an example of part of the fixing device illustrated in FIG. 10 in a separated state.

Referring also to FIGS. 10 to 12B in addition to FIGS. 1 to 9B, a detailed configuration of the lower unit 47 is described. FIG. 10 is a front view of an appearance of the lower unit 47 viewed from the upstream side. FIG. 11A is a side view of part of the fixing device 105 in a regular pressure state, viewed from a direction indicated by an arrow "d" illustrated in FIG. 10. FIG. 11B is a side view of part of the fixing device 105 in the regular pressure state, viewed from a direction indicated by an arrow "e" illustrated in FIG. 10. FIG. 12A is a side view of part of the fixing device 105 in a reduced pressure state, viewed from the direction indicated by the arrow "d". FIG. 12B is a side view of part of the fixing device 105 in a separated state, viewed from the direction indicated by the arrow "d".

The lower unit 47 may include a lower chassis 86, a first cam shaft 87, first supporting parts 88L and 88R, first cams L1 and R1, first cam gears LG1 and RG1, a second cam shaft 89, second supporting parts 90L and 90R, second cams L2 and R2, and second cam gears LG2 and RG2. The lower chassis 86 may be fixed to the upper chassis 59 by means of a screw, for example. The first cam shaft 87 and the second cam shaft 89 may be adjacent to each other in the Z-axis direction, and extend in the X-axis direction. The first cam shaft 87 may be attached to the lower chassis 86 in a rotatable manner with the first supporting parts 88L and 88R in between. The second cam shaft 89 may be attached to the lower chassis 86 in a rotatable manner with the second supporting parts 90L and 90R in between.

The first cam gear LG1 may be provided at one end of the first cam shaft 87, and the first cam gear RG1 may be provided at the other end of the first cam shaft 87. Further, each of the first cams L1 and R1 may be fixed, between the first cam gear LG1 and the first cam gear RG1, to the first cam shaft 87. In one example, the first cam L1 may be in contact with the first cam gear LG1, and the first cam R1 may be in contact with the first cam gear RG1. The first cam shaft 87, the first cams L1 and R1, and the first cam gears LG1 and RG1 may rotate together around an axis 87J that extends in the X-axis direction.

The second cam gear LG2 may be provided at one end of the second cam shaft 89, and the second cam gear RG2 may be provided at the other end of the second cam shaft 89. Further, each of the second cams L2 and R2 may be fixed, between the second cam gear LG2 and the second cam gear RG2, to the second cam shaft 89. In one example, the second cam L2 may be in contact with the second cam gear LG2, and the second cam R2 may be in contact with the second cam gear RG2. The second cam shaft 89, the second cams L2 and R2, and the second cam gears LG2 and RG2 may rotate together around an axis 89J that extends in the X-axis direction.

For example, referring to FIGS. 11A and 11B, the first cam L1 and the second cam L2 may be symmetric with respect to a virtual center plane S that is parallel to the X-Y plane. Specifically, the first cam L1 may include a cam surface AL1, a cam surface BL1, and a cam surface CL1. The second cam L2 may include a cam surface AL2, a cam surface BL2, and a cam surface CL2. The cam surface AL1 and the cam surface AL2 may be located in a symmetric manner with respect to the center plane S. The cam surface BL1 and the cam surface BL2 may be located in a symmetric manner with respect to the center plane S. The cam surface CL1 and the cam surface CL2 may be located in a symmetric manner with respect to the center plane S. The foregoing relationship may be similarly applicable to a relationship between the first cam R1 and the second cam R2. That is, the first cam R1 and the second cam R2 may be symmetric with respect to the virtual center plane S that is parallel to the X-Y plane. Specifically, the first cam R1 may include a cam surface AR1, a cam surface BR1, and a cam surface CR1. The second cam R2 may include a cam surface AR2, a cam surface BR2, and a cam surface CR2. The cam surface AR1 and the cam surface AR2 may be located in a symmetric manner with respect to the center plane S. The cam surface BR1 and the cam surface BR2 may be located in a symmetric manner with respect to the center plane S. The cam surface CR1 and the cam surface CR2 may be located in a symmetric manner with respect to the center plane S. Further, the first cam L1 and the first cam R1 may have shapes and sizes that are substantially coincident with each other when viewed from the X-axis direction. Similarly, the second cam L2 and the second cam R2 may have shapes and sizes that are substantially coincident with each other when viewed from the X-axis direction.

In the first cam L1, the cam surface AL1 may be located at a position that is the farthest from the axis 87J of the first cam shaft 87 among the cam surfaces AL1, BL1, and CL1. The position of the cam surface AL1 may have a distance A from the axis 87J of the first cam shaft 87. In the first cam R1, the cam surface AR1 may be located at a position that is the farthest from the axis 87J of the first cam shaft 87 among the cam surfaces AR1, BR1, and CR1. The position of the cam surface AR1 may have the distance A from the axis 87J of the first cam shaft 87. In the second cam L2, the cam surface AL2 may be located at a position that is the farthest from the axis 89J of the second cam shaft 89 among the cam surfaces AL2, BL2, and CL2. The position of the cam surface AL2 may have the distance A from the axis 89J of the second cam shaft 89. In the second cam R2, the cam surface AR2 may be located at a position that is the farthest from the axis 89J of the second cam shaft 89 among the cam surfaces AR2, BR2, and CR2. The position of the cam surface AR2 may have the distance A from the axis 89J of the second cam shaft 89.

Further, the cam surfaces BL1 and BR1 may be located at respective positions that each have a distance B from the axis 87J. The cam surfaces CL1 and CR1 may be located at respective positions that each have a distance C from the axis 87J. Further, the cam surfaces BL2 and BR2 may be located at respective positions that each have the distance B from the axis 89J. The cam surfaces CL2 and CR2 may be located at respective positions that each have the distance C from the axis 89J.

The intermediate chassis 65 in the intermediate unit 46 may have one end, in the X-axis direction, that is provided with contact projecting plates 93L and 94L. The intermediate chassis 65 in the intermediate unit 46 may have the other end, in the X-axis direction, that is provided with contact projecting plates 93R and 94R. The contact projecting plate 93L may be brought into contact with any of the cam surfaces AL1, BL1, and CL1 depending on a rotation position of the first cam L1. The contact projecting plate 93R may come into contact with any one of the cam surfaces AR1, BR1, and CR1 depending on a rotation position of the first cam R1. The contact projecting plate 94L may come into contact with any one of the cam surfaces AL2, BL2, and CL2 depending on a rotation position of the second cam L2. The contact projecting plate 94R may come into contact with any one of the cam surfaces AR2, BR2, and CR2 depending on a rotation position of the second cam R2.

The intermediate chassis 65 in the intermediate unit 46 may have first slits 91L and 91R, second slits 92L and 92R, and third slits 96L and 96R, each of which extends in the Y-axis direction. The upper chassis 59 in the upper unit 45 may be provided with posts 95L and 95R. The first cam shaft 87 may be inserted into the first slits 91L and 91R, the second cam shaft 89 may be inserted into the second slits 92L and 92R, and the posts 95L and 95R may be respectively inserted into the third slits 96L and 96R, in the fixing device 105. The first cam shaft 87, the second cam shaft 89, the post 95L, and the post 95R may be guided in the Y-axis direction by the first slits 91L and 91R, the second slits 92L and 92R, the third slit 96L, and the third slit 96R, respectively.

As described above, the contact projecting plates 93L, 93R, 94L, and 94R may be constantly in contact with the first cams L1 and R1 and the second cams L2 and R2, respectively, as a result of the weight itself of the intermediate unit 46. Accordingly, the positions, in the Y-axis direction, of the contact projecting plates 93L, 93R, 94L, and 94R may be varied in accordance with the rotation operations of the respective first cams L1 and R1 and the respective second cams L2 and R2. This may cause the intermediate chassis 65 to be move in the top-bottom direction, i.e., in the Y-axis direction. For example, the intermediate chassis 65 may be located at a highest position when the cam surfaces AL1, AR1, AL2, and AR2 respectively come into contact with the contact projecting plates 93L, 93R, 94L, and 94R. The intermediate chassis 65 may be located at a lowest position when the cam surfaces CL1, CR1, CL2, and CR2 respectively come into contact with the contact projecting plates 93L, 93R, 94L, and 94R. The intermediate chassis 65 may be located at an intermediate position when the cam surfaces BL1, BR1, BL2, and BR2 respectively come into contact with the contact projecting plates 93L, 93R, 94L, and 94R. One reason for this is that the distance A is greater than both the distance B and the distance C, and the distance C is smaller than both the distance A and the distance B.

EXAMPLE WORKINGS AND EXAMPLE EFFECTS

[A. Basic Operation]

The image forming apparatus may transfer the toner image onto the recording medium in the following manner, for example.

Specifically, referring to FIG. 1A, first, the recording media contained in the medium cassette 24 may be picked up one by one from the top by the medium feeding roller 11. The recording medium picked up may be fed by the medium feeding roller 11 toward the medium conveying unit 102 provided downstream of the medium feeding roller 11. Thereafter, the recording medium fed from the medium feeding roller 11 may be conveyed by the medium conveying unit 102 toward the image forming unit 103 and the transferring unit 104 that are provided downstream of the medium conveying unit 102, while a skew of the recording medium is corrected by the medium conveying unit 102. The toner image may be transferred onto the conveyed recording medium in the following manner in the image forming unit 103 and the transferring unit 104.

When the print image data and the printing order are inputted to the print controller 700 in the activated image forming apparatus 1 from the external device such as a PC via the I/F controller 710, the print controller 700 may start a printing operation of the print image data in cooperation with controllers such as the image formation driving controller 780 in response to the inputted printing order.

The image formation driving controller 780 may drive the respective driving motors 781 to 784, and thereby cause the respective photosensitive drums 4K, 4Y, 4M, and 4C to rotate in a predetermined direction at a constant speed. Upon the rotation of the photosensitive drums 4K, 4Y, 4M, and 4C, the power derived from the rotation may be transmitted to each of the toner feeding sponge rollers 9K, 9Y, 9M, and 9C, the developing rollers 6K, 6Y, 6M, and 6C, and the charging rollers 5K, 5Y, 5M, and 5C, via a driving transmitter such as a gear train. As a result, the toner feeding sponge rollers 9K, 9Y, 9M, and 9C, the developing rollers 6K, 6Y, 6M, and 6C, and the charging rollers 5K, 5Y, 5M, and 5C may rotate in respective predetermined directions.

In response to the instruction given by the print controller 700, the charging voltage controller 740 may apply predetermined voltages to the respective charging rollers 5K, 5Y, 5M, and 5C, and thereby evenly charge the respective surfaces of the photosensitive drums 4K, 4Y, 4M, and 4C.

Thereafter, the head driving controller 750 may activate the respective LED heads 3K, 3Y, 3M, and 3C, and thereby apply, to the respective photosensitive drums 4K, 4Y, 4M, and 4C, light corresponding to the print image based on the image signal. The electrostatic latent images may be thereby formed on the respective surfaces of the photosensitive drums 4K, 4Y, 4M, and 4C. Further, the toners may be fed from the toner tanks 7K, 7Y, 7M, and 7C to the toner feeding sponge rollers 9K, 9Y, 9M, and 9C, respectively. The toners may be supported by the respective toner feeding sponge rollers 9K, 9Y, 9M, and 9C, and may be moved into the vicinity of the respective developing rollers 6K, 6Y, 6M, and 6C, in accordance with the rotation of the toner feeding sponge rollers 9K, 9Y, 9M, and 9C. In the vicinity of the developing rollers 6K, 6Y, 6M, and 6C, the toners may be charged, for example, negatively as a result of potential differences between the developing rollers 6K, 6Y, 6M, and 6C and the toner feeding sponge rollers 9K, 9Y, 9M, and 9C. The toners fed to the developing rollers 6K, 6Y, 6M, and 6C may be formed into toner layers that have predetermined thicknesses controlled by the respective developing blades 8K, 8Y, 8M, and 8C.

Further, the toner layers formed on the developing rollers 6K, 6Y, 6M, and 6C may be developed on the basis of the electrostatic latent images formed on the surfaces of the photosensitive drums 4K, 4Y, 4M, and 4C, respectively. The toner images may be thereby formed on the respective photosensitive drums 4K, 4Y, 4M, and 4C. The formed toner images may be transferred onto the recording medium by means of electric fields between the photosensitive drums 4K, 4Y, 4M, and 4C and the transfer rollers 10K, 10Y, 10M, and 10C that respectively face the photosensitive drums 4K, 4Y, 4M, and 4C, and each receive a predetermined voltage from the transfer voltage controller 770.

Thereafter, the toner images transferred onto the recording medium may be applied with heat and pressure in the fixing device 105. The toner images may be thereby fixed to the recording medium. Thereafter, the recording medium to which the toner images are fixed may be discharged to the outside by the discharging unit 106. In some cases, a small amount of toners that have not been transferred onto the recording medium may remain on the photosensitive drums 4K, 4Y, 4M, and 4C. In such cases, the remained toners may be removed by the photosensitive-drum blades 26K, 26Y, 26M, and 26C. Hence, the photosensitive drums 4K, 4Y, 4M, and 4C may be used continuously.

[B. Operation of Fixing Device 105]

An operation of the fixing device 105 may be classified into three modes on the basis of the attitudes, i.e., the rotation positions, of the first cams L1 and R1 and the second cams L2 and R2. The foregoing three modes may include a regular printing mode, a special printing mode, and a standby mode, that may be also referred to as a regular pressure mode, a reduced pressure mode, and a separated mode, respectively.

[Regular Printing Mode]

Figure 13A:
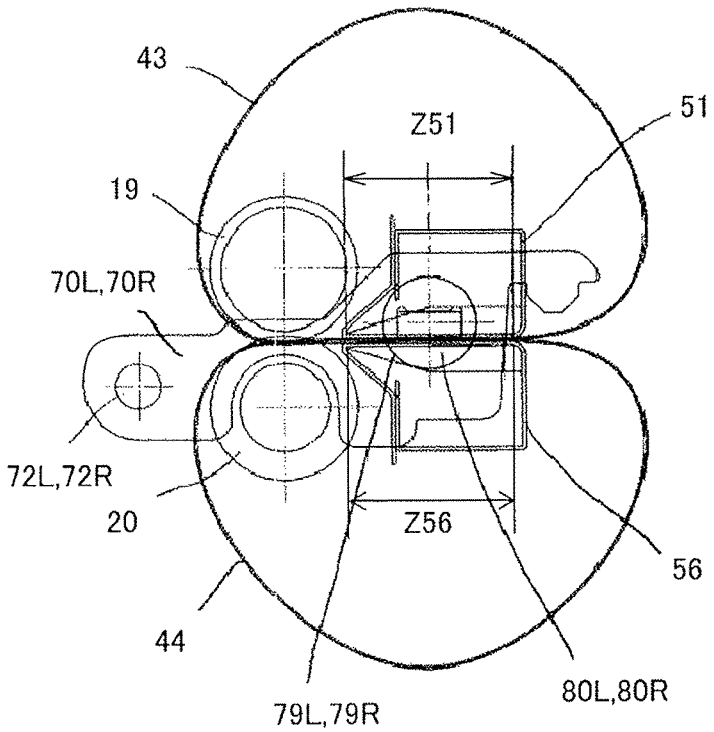
FIG. 13A schematically illustrates an example of a positional relationship between a fixing unit and a pressure applying unit corresponding to a regular pressure mode in the fixing device illustrated in FIG. 4.
Figure 13B:
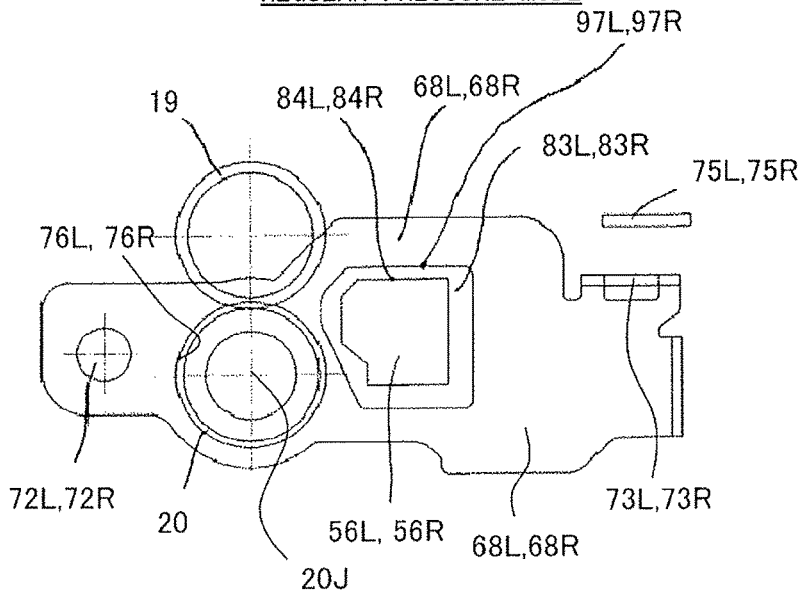
FIG. 13B also schematically illustrates the example of the positional relationship between the fixing unit and the pressure applying unit corresponding to the regular pressure mode in the fixing device illustrated in FIG. 4.

The regular printing mode is described with reference to FIGS. 13A and 13B. The print controller 700 may distinguish the type of the recording medium, and perform the following operation when the recording medium is a regular medium. The regular medium may refer to a medium that is not a special medium. Examples of the special medium may include an envelope, thin paper, a pharmaceutical package, that are easily wrinkled. Specifically, the cam motor 794 may be driven by the fixing controller 790 to cause the first cam gears LG1 and RG1 and the second cam gears LG2 and RG2 to rotate together. As a result, the first cams L1 and R1 and the second cams L2 and R2 may be so held as to have the attitudes illustrated in FIGS. 11A and 11B. In other words, in the regular printing mode, the rotation of the first cam gears LG1 and RG1 and the second cam gears LG2 and RG2 may be stopped in a state where the contact projecting plates 93L, 93R, 94L, and 94R come into contact with the cam surface AL1 of the first cam L1, the cam surface AR1 of the first cam R1, the cam surface AL2 of the second cam L2, and the cam surface AR2 of the second cam R2, respectively. Accordingly, the contact projecting plates 93L and 93R may be held at respective positions having the distance A from the axis 87J, and the contact projecting plates 94L and 94R may be held at respective positions having the distance A from the axis 89J. This may cause the intermediate chassis 65 to be held at the highest positions among its positions in the foregoing three modes. Further, the holding arms 68L and 68R may be caused to pivot upward around the rotation shafts 72L and 72R by the biasing force derived from the first biasing members 74L and 74R, respectively. This may bias the pressure applying roller 20 toward the fixing roller 19 with the pressure applying belt 44 and the fixing belt 43 in between. In this state, the holding arms 68L and 68R may extend in a direction that is almost coincident with the Z-axis direction, and the upper ends of the stoppers 73L and 73R of the holding arms 68L and 68R may be separated away from the lower ends of the movement limiting parts 75L and 75R in the intermediate chassis 65, respectively. Further, the holding arms 70L and 70R may be caused to pivot upward around the rotation shafts 72L and 72R by the biasing force derived from the second biasing members 78L and 78R, respectively. This may bias the flat part 56T of the pressure applying pad 56 toward the flat part 51T of the fixing pad 51 with the pressure applying belt 44 and the fixing belt 43 in between. As a result, the nip portion N may be formed at the boundary between the pressure applying belt 44 and the fixing belt 43, as illustrated in FIG. 5C.

In the regular printing mode, a gap may be present between the contact surfaces 84L and 84R and the edges 97L and 97R of the through holes 83L and 83R provided in the holding arms 68L and 68R, respectively. This may allow the pressure applying pad 56 to so rotate around the rotation axis 56J that the flat part 56T has an attitude that is substantially parallel to the flat part 51T in accordance with the attitude of the fixing pad 51. As a result, it is possible to avoid a so-called partial contact state in which contact by pressing occurs only in part of the nip portion N in the Z-axis direction. It is therefore possible to achieve nip pressure that is highly even over the entire nip portion N. In particular, it may be possible to further reduce variation in nip pressure in the nip portion N, when the center position of the flat part 51T of the fixing pad 51 and the center position of the flat part 56T of the pressure applying pad 56 are caused to be substantially coincident with each other.

[Special Printing Mode]

Figure 14A:
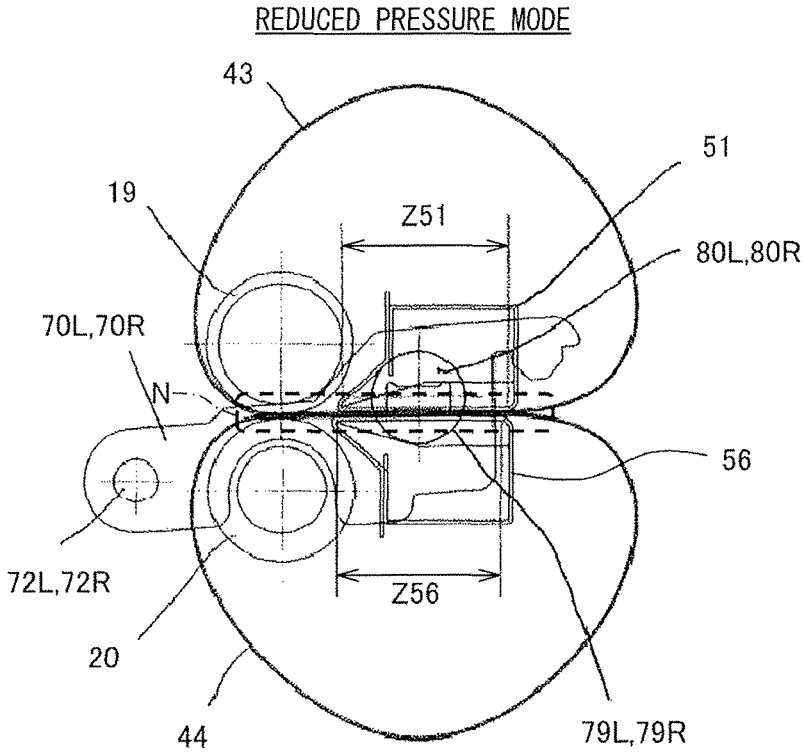
FIG. 14A schematically illustrates an example of a positional relationship between the fixing unit and the pressure applying unit corresponding to a reduced pressure mode in the fixing device illustrated in FIG. 4.
Figure 14B:
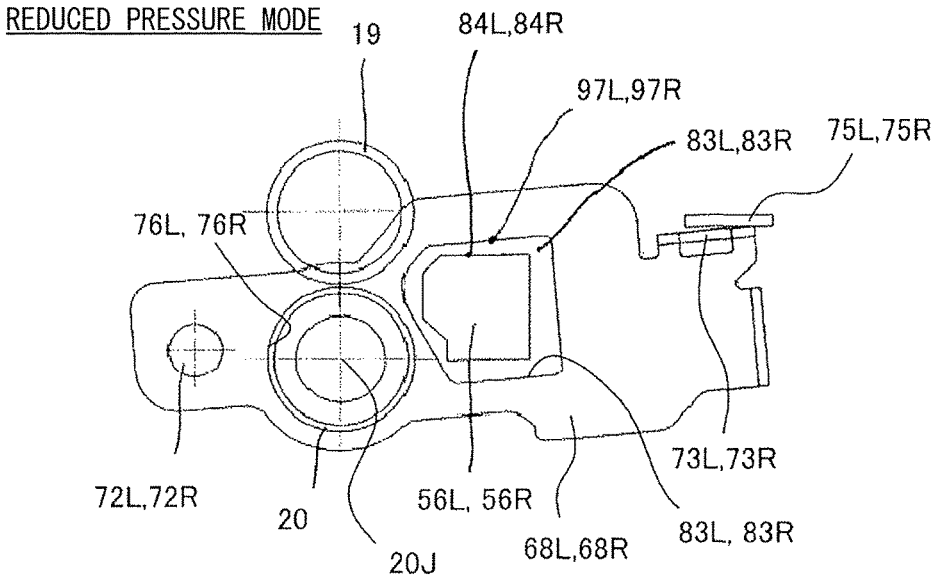
FIG. 14B also schematically illustrates the example of the positional relationship between the fixing unit and the pressure applying unit corresponding to the reduced pressure mode in the fixing device illustrated in FIG. 4.

A special printing mode is described with reference to FIGS. 14A and 14B. The special printing mode may perform the fixing operation on the recording medium that is the special medium. Examples of the special medium may include an envelope, thin paper, a pharmaceutical package, that are easily wrinkled. The special printing mode may perform the fixing operation at nip pressure that is lower than the nip pressure in the regular printing mode. The following operation may be performed when the print controller 700 determines that the recording medium is the special medium. Specifically, the cam motor 794 may be driven by the fixing controller 790 to cause the first cam gears LG1 and RG1 and the second cam gears LG2 and RG2 to rotate together. As a result, the first cams L1 and R1 and the second cams L2 and R2 may be so held as to have the respective attitudes illustrated in FIG. 12A. In other words, in the special printing mode, the rotation of the first cam gears LG1 and RG1 and the second cam gears LG2 and RG2 may be stopped in a state where the contact projecting plates 93L, 93R, 94L, and 94R come into contact with the cam surface BL1 of the first cam L1, the cam surface BR1 of the first cam R1, the cam surface BL2 of the second cam L2, and the cam surface BR2 of the second cam R2, respectively. Accordingly, the contact projecting plates 93L and 93R may be held at respective positions having the distance B from the axis 87J, and the contact projecting plates 94L and 94R may be held at respective positions having the distance B from the axis 89J. This may cause the intermediate chassis 65 to be held at a position that is slightly lower in the Y-axis direction than the position of the intermediate chassis 65 in the regular printing mode. Accordingly, referring to FIG. 14B, the holding arms 68L and 68R may be caused to pivot upward around the rotation shafts 72L and 72R by the biasing force derived from the first biasing members 74L and 74R at an angle that is greater than an angle at which the holding arms 68L and 68R pivot in the regular printing mode, respectively. When the holding arms 68L and 68R pivot, the holding arms 68L and 68R may be slightly inclined compared with the state of the holding arms 68L and 68R in the regular printing mode, respectively. This may cause the upper ends of the stoppers 73L and 73R of the holding arms 68L and 68R to come into contact with the lower ends of the movement limiting parts 75L and 75R in the intermediate chassis 65, respectively. As a result, the pressure applying roller 20 supported by the holding arms 68L and 68R may be biased toward the fixing roller 19 with the pressure applying belt 44 and the fixing belt 43 in between by force that is smaller than the force by which the pressure applying roller 20 is biased toward the fixing roller 19 in the regular printing mode.

In the special printing mode, a gap may be also present between the contact surfaces 84L and 84R and the edges 97L and 97R of the through holes 83L and 83R provided in the holding arms 68L and 68R, respectively, as in the regular printing mode. This may allow the pressure applying pad 56 to so rotate around the rotation axis 56J that the flat part 56T has an attitude that is substantially parallel to the flat part 51T in accordance with the attitude of the fixing pad 51. The holding arms 70L and 70R may be therefore caused to pivot upward around the rotation shafts 72L and 72R by the biasing force derived from the second biasing members 78L and 78R, respectively. The flat part 56T of the pressure applying pad 56 may be thereby biased toward the flat part 51T of the fixing pad 51 with the pressure applying belt 44 and the fixing belt 43 in between. The holding arms 70L and 70R, however, may be caused to pivot upward around the rotation shafts 72L and 72R by the biasing force derived from the second biasing members 78L and 78R at an angle that is greater than an angle at which the holding arms 70L and 70R pivot in the regular printing mode, respectively. One reason for this is that the intermediate chassis 65 is held at a position slightly lower in the Y-axis direction in the special printing mode than in the regular printing mode. Therefore, the biasing force derived from the second biasing members 78L and 78R may be smaller in the special printing mode than in the regular printing mode. In other words, the pressure applying pad 56 may be biased toward the fixing pad 51 by force that is smaller than that in the regular printing mode.

As a result of the matters described above, in the special printing mode, the nip portion N may be also formed at the boundary between the pressure applying belt 44 and the fixing belt 43; however, the pressure applying belt 44 and the fixing belt 43 may be so pressed against each other as to be in contact with each other in the nip portion N by force that is smaller than that in the regular printing mode. The pressure applying pad 56 may be so rotatable around the rotation axis 56J that the flat part 56T has an attitude that is substantially parallel to the flat part 51T in accordance with the attitude of the fixing pad 51, also in the special printing mode. As a result, it is possible to avoid a so-called partial contact state in which contact by pressing occurs only in part of the nip portion N in the Z-axis direction. It is therefore possible to achieve nip pressure that is highly even over the entire nip portion N. In the special printing mode, however, the holding arms 70L and 70R may be slightly inclined compared with the state of the holding arms 70L and 70R in the regular printing mode, respectively. This may cause the nip portion N to be so formed that the center position of the flat part 51T of the fixing pad 51 and the center position of the flat part 56T of the pressure applying pad 56 are slightly shifted from each other in the Z-axis direction.

Figure 15A:
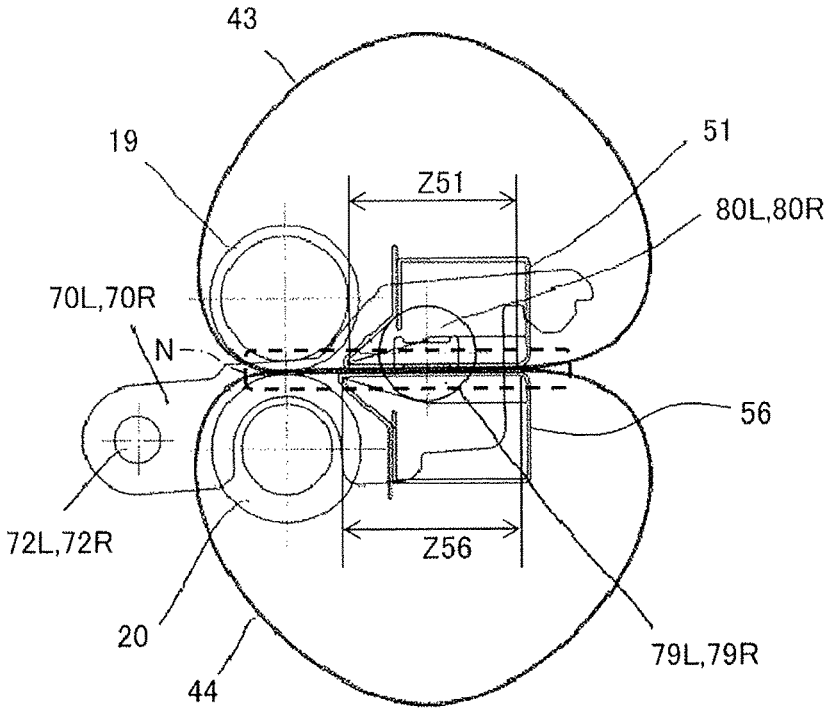
FIG. 15A schematically illustrates an example of a positional relationship between the fixing unit and the pressure applying unit corresponding to the reduced pressure mode in the fixing device illustrated in FIG. 4 in a case where a pressure applying pad has a great width.
Figure 15B:
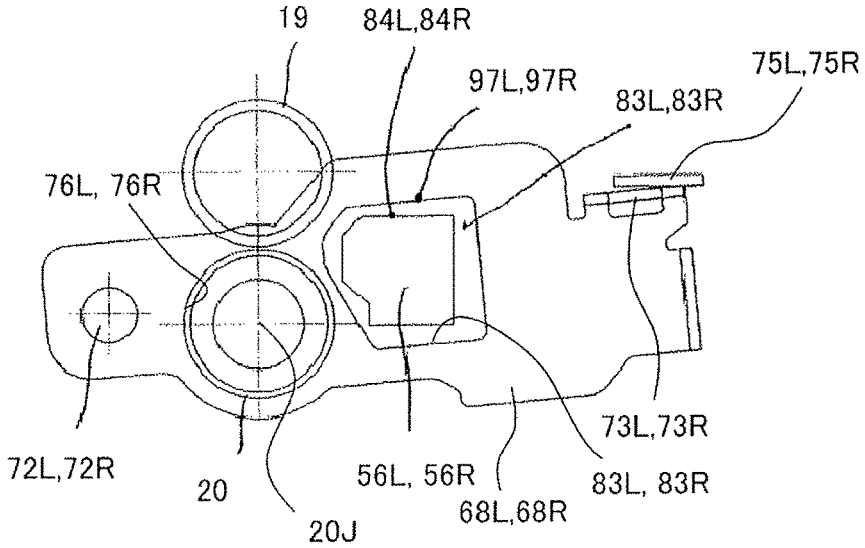
FIG. 15B also schematically illustrates the example of the positional relationship between the fixing unit and the pressure applying unit corresponding to the reduced pressure mode in the fixing device illustrated in FIG. 4 in a case where the pressure applying pad has the great width.

To address this, referring to a modification example illustrated in FIGS. 15A and 15B, a dimension Z56 of the pressure applying pad 56 in the Z-axis direction may be set slightly greater than a dimension Z51 of the fixing pad 51 in the Z-axis direction. This may secure a sufficiently long nip width also in the special printing mode. As a result, it is possible to achieve a more stable fixing operation.

[Standby Mode]

Figure 16A:
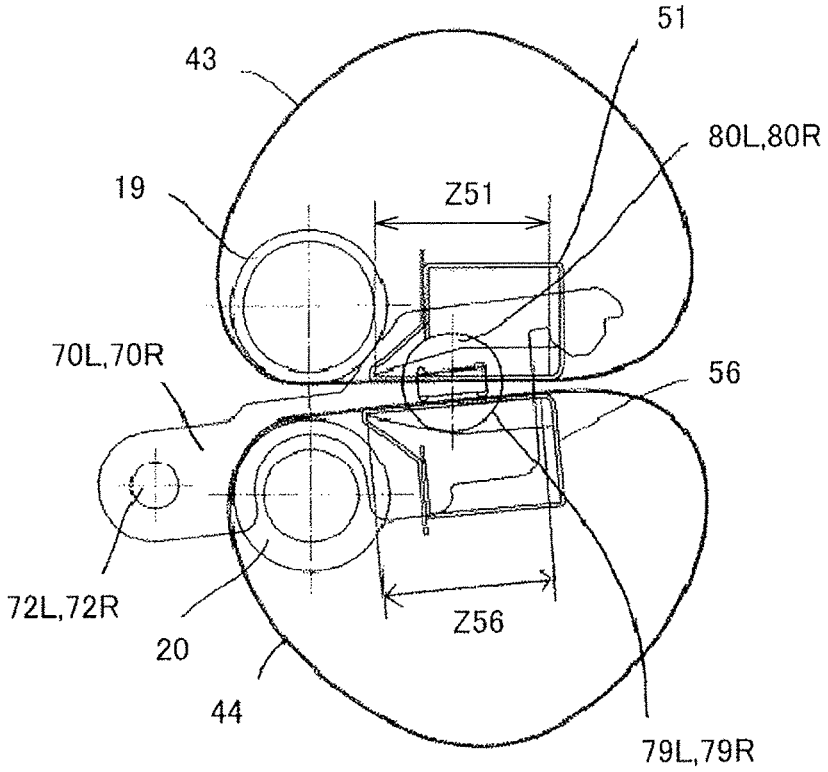
FIG. 16A schematically illustrates an example of the positional relationship between the fixing unit and the pressure applying unit corresponding to a separated mode in the fixing device illustrated in FIG. 4.
Figure 16B:
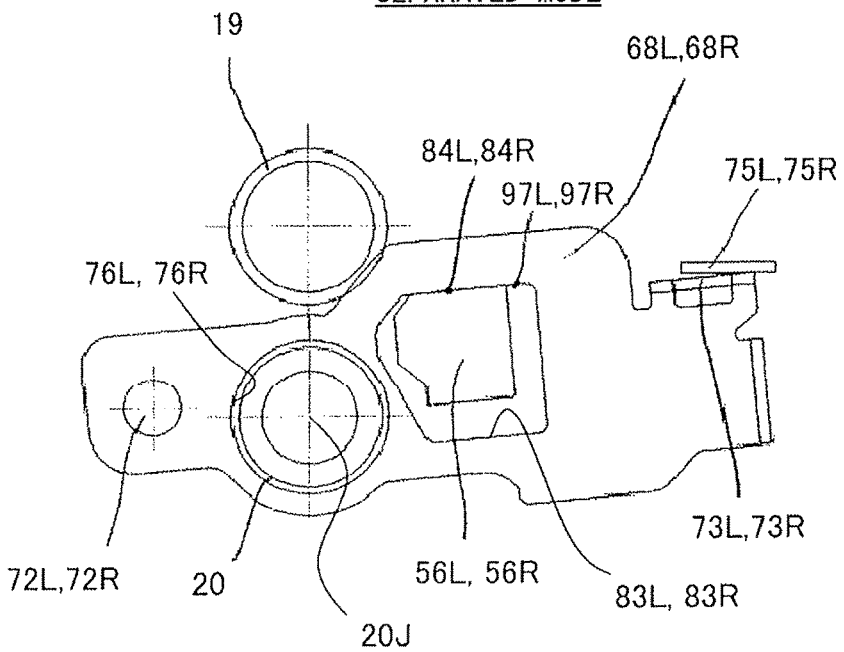
FIG. 16B also schematically illustrates the example of the positional relationship between the fixing unit and the pressure applying unit corresponding to the separated mode in the fixing device illustrated in FIG. 4.

A standby mode is described with reference to FIGS. 16A and 16B. The standby mode may correspond to a state where no fixing operation is performed on the recording medium. The following operation may be performed when the print controller 700 determines that no fixing operation is to be performed on the recording medium. Specifically, the cam motor 794 may be driven by the fixing controller 790 to cause the first cam gears LG1 and RG1 and the second cam gears LG2 and RG2 to rotate together. As a result, the first cams L1 and R1 and the second cams L2 and R2 may be so held as to have the respective attitudes illustrated in FIG. 12B. In other words, in the standby mode, the rotation of the first cam gears LG1 and RG1 and the second cam gears LG2 and RG2 may be stopped in a state where the contact projecting plates 93L, 93R, 94L, and 94R are brought into contact with the cam surface CL1 of the first cam L1, the cam surface CR1 of the first cam R1, the cam surface CL2 of the second cam L2, and the cam surface CR2 of the second cam L2, respectively. Accordingly, the contact projecting plates 93L and 93R may be held at respective positions having the distance C from the axis 87J, and the contact projecting plates 94L and 94R may be held at respective positions having the distance C from the axis 89J. This may cause the intermediate chassis 65 to be held at a position that is further lower in the Y-axis direction than the position of the intermediate chassis 65 in the special printing mode. Accordingly, referring to FIG. 16B, the upper ends of the stoppers 73L and 73R of the holding arms 68L and 68R may come into contact with the lower ends of the movement limiting parts 75L and 75R in the intermediate chassis 65, respectively, in the standby mode as in the special printing mode. In the standby mode, however, the positions of the rotation shafts 72L and 72R may be further lower than those in the special printing mode. This may cause the holding arms 68L and 68R to be inclined at an angle that is further greater than that in the special printing mode. As a result, the pressure applying roller 20 supported by the holding arms 68L and 68R may be held at respective positions separated away from the fixing roller 19, without biasing the fixing roller 19.

Further, the holding arms 70L and 70R may pivot upward around the rotation shafts 72L and 72R by the biasing force derived from the second biasing members 78L and 78R, respectively. It is to be noted that the holding arms 68L and 68R may be inclined at the angle that is further greater in the standby mode than in the special printing mode and the regular printing mode, as described above. Therefore, unlike in the special printing mode and the regular printing mode, the contact surfaces 84L and 84R of the projections 56L and 56R may come into contact with the edges 97L and 97R of the through holes 83L and 83R provided in the holding arms 68L and 68R, respectively, in the standby mode. This state may limit angles at which the respective holding arms 70L and 70R rotate. As a result, no nip portion N may be formed at the boundary between the pressure applying belt 44 and the fixing belt 43, and the pressure applying belt 44 and the fixing belt 43 may be separated away from each other.

[C. Example Effects]

The fixing device 105 according to the example embodiment may be able to perform transition in state by controlling the attitudes of the first cams L1 and R1 and the second cams L2 and R2, as described above. The transition in state may be performed between the three modes, i.e., the regular printing mode and the special printing mode that each perform printing on the recording medium and the standby mode that performs no printing on the recording medium. In the regular printing mode and the special printing mode, the pressure applying pad 56 may be supported, by the holding arms 70L and 70R, variably in attitude of the pressure applying pad 56 relative to the holding arms 70L and 70R. In other words, the pressure applying pad 56 may have an attitude that is variable relative to the pressure applying roller 20 and relative to both the fixing belt 43 and the fixing pad 51. More in detail, the pressure applying pad 56 may be allowed to so rotate around the rotation axis 56J that the flat part 56T has an attitude that is substantially parallel to the flat part 51T in accordance with the attitude of the fixing pad 51. As a result, it is possible to avoid the so-called partial contact state in which contact by pressing occurs only in part of the nip portion N in the Z-axis direction. Hence, it is possible to achieve nip pressure that is highly even over the entire nip portion N.

According to the image forming apparatus 1 provided with the fixing device 105 of the example embodiment, it is therefore possible to perform the fixing process at stable nip pressure. Hence, it is possible to prevent a decrease in fixing rate or a defect in image, for example, and thereby improve the quality of the image.

2. Modification Example

The technology has been described above referring to the example embodiments thereof. However, the technology is not limited to the example embodiments described above, and is modifiable in various ways. For example, the foregoing example embodiments are described referring to the image forming apparatus that forms a color image; however, the technology is not limited thereto. The technology is also applicable to an image forming apparatus that forms a monochrome image by transferring only a black toner image, for example. Further, for example, the foregoing example embodiments are described referring to the image forming apparatus of a primary transfer scheme, i.e., a direct transfer scheme. The technology is, however, also applicable to a second transfer scheme.

Moreover, the foregoing example embodiments refer to the example in which two sets of cams may be disposed in the Z-axis direction, in which each of the two sets of cams may be disposed at respective ends of the cam shaft in the X-axis direction. The Z-axis direction may correspond to a "first direction" in one specific but non-limiting embodiment of the technology. The technology is not limited to the foregoing example including the two sets of cams. Alternatively, for example, only one cam or one set of cams may be provided. Alternatively, for example, three or more sets of cams may be provided. The operation of the intermediate unit 46 in the top-bottom direction, however, may be further stabilized by providing the two sets of cams, compared with the example case including only one cam or one set of cams. In addition, the example case including the two sets of cams may be more advantageous in simplification of the structure, compared with the example case including three or more sets of cams.

Moreover, the foregoing example embodiments refer to three modes, i.e., the regular printing mode (the regular pressure mode), the special printing mode (the reduced pressure mode), and the standby mode (the separated mode), as examples of the operation mode of the fixing device 105; however, the technology is not limited thereto. Alternatively, for example, the pressing force in the reduced pressure mode may be classified more finely. For example, another mode may be additionally provided such as a mode that causes the fixing pad 51 and the pressure applying pad 56 to be separated away from each other while causing the fixing roller 19 and the pressure applying roller 20 to come into contact with each other.

Moreover, the foregoing example embodiments refer to the example in which the LED head including a light-emitting diode as its light source is used as the exposure device; however, the technology is not limited thereto. Alternatively, an exposure device including a component such as a laser element as its light source may be used, for example.

Moreover, the foregoing example embodiments and the foregoing modification examples refer to the image forming apparatus having a printing function as an example corresponding to the "image forming apparatus" in one specific but non-limiting embodiment of the technology; however, the function of the image forming apparatus is not limited thereto. Specifically, for example, the technology is also applicable to an image forming apparatus that serves as a multi-function peripheral having functions such as a scanner function and a facsimile function in addition to the printing function, for example.

Furthermore, the technology encompasses any possible combination of some or all of the various embodiments and the modifications described herein and incorporated herein.

It is possible to achieve at least the following configurations from the above-described example embodiments of the technology.

(1)

A fixing device including:

a first unit that includes a first belt being movable in a first direction, a first pressing member pressing the first belt, and a first pressing member support supporting the first pressing member; and a second unit that includes a moving member and faces the first unit in a second direction, the moving member being able to come into contact with the first belt and movable in the first direction, in which the first pressing member is supported, by the first pressing member support, variably in attitude of the first pressing member relative to the first pressing member support.

(2)

The fixing device according to (1), in which the first pressing member is provided rotatably, relative to the first pressing member support, around a rotation axis, the rotation axis being substantially orthogonal to both the first direction and the second direction.

(3)

The fixing device according to (1) or (2), in which the first unit further includes a first rotating member that is in contact with the first belt and rotatable in a first rotation direction, and a first rotating member support that supports the first rotating member, and in which the first rotating member is supported, by the first rotating member support, variably in position of the first rotating member relative to the moving member.

(4)

The fixing device according to (3), further including a third unit that faces the second unit with the first unit in between in the second direction, in which the first unit is supported, by the second unit and the third unit, movably in the second direction between the second unit and the third unit.

(5)

The fixing device according to (4), in which the first unit further includes a first base to which each of the first rotating member support and the first pressing member support is attached pivotally.

(6)

The fixing device according to (5), in which each of the first rotating member support and the first pressing member support is attached pivotally to a same shaft, the shaft being provided in the first base.

(7)

The fixing device according to (5) or (6), in which the moving member includes a second belt, and the second unit further includes a second rotating member that is in contact with the second belt and rotatable in a second rotation direction that is opposite to the first rotation direction, a second pressing member that presses the second belt, and a second base that supports the second rotating member and the second pressing member.

(8)

The fixing device according to (7), in which the third unit includes a third base, and a cam that includes a cam surface and is provided, in the third base, rotatably around a cam shaft, the cam shaft extending in a third direction that is substantially orthogonal to the second direction, and in which the first base includes a contact part that comes into contact with the cam surface.

(9)

The fixing device according to (8), in which the first unit is caused to move in the second direction by variation in position of the cam surface in the second direction in accordance with rotation of the cam.

(10)

The fixing device according to (2), in which the rotation axis is located, in the first direction, at one of a position that is coincident with a first center position of the first pressing member in the first direction, and a position that is located downstream of the first center position of the first pressing member in the first direction.

(11)

The fixing device according to (7), in which the first pressing member has a first dimension in the first direction that is greater than a second dimension of the second pressing member in the first direction.

(12)

The fixing device according to (3), in which the first unit further includes a first biasing member that biases the first rotating member support and thereby allows the first rotating member to be closer to the second unit in the second direction, and a second biasing member that biases the first pressing member support and thereby allows the first pressing member to be closer to the second unit in the second direction.

(13)

The fixing device according to (12), in which the first unit further includes a movement limiting part that limits movement of the first rotating member support toward the second unit, and the first pressing member support is limited in movement toward the second unit by coming into contact with part of the first rotating member support.

(14)

The fixing device according to any one of (1) to (13), in which the first unit further includes a heater, the heater generating heat that is transmitted to the first belt.

(15)

The fixing device according to (3), in which the first belt has a looped shape, and each of the first rotating member and the first pressing member is disposed in space surrounded by the first belt.

(16)

The fixing device according to any one of (1) to (15), in which the first belt and the moving member form a nip portion by coming into contact with each other, and the first belt and the moving member are movable in the first direction in the nip portion.

(17)

An image forming apparatus provided with the fixing device according to any one of (1) to (16).

In the fixing device according to one embodiment of the technology, the first pressing member in the first unit is variable in attitude of the first pressing member relative to both the moving member in the second unit and the first rotating member.

According to the fixing device and the image forming apparatus of one embodiment of the technology, it is possible to provide a fixing device and an image forming apparatus that are suitable for achieving an image with improved quality.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. A fixing device, comprising:

a first unit that includes:

a first belt that is movable in a first direction;

a first pressing member that presses the first belt;

a first pressing member support that supports the first pressing member variably in attitude relative to the first pressing member support;

a first rotating member that is in contact with the first belt and that is rotatable in a first rotation direction; and a first rotating member support that supports the first rotating member variably in position relative to the moving member;

a second unit that includes a moving member and that faces the first unit in a second direction, the moving member being able to come into contact with the first belt and being movable in the first direction, and a third unit that faces the second unit with the first unit positioned in between in the second direction and supported by the second unit and the third unit movably in the second direction between the second unit and the third unit.

2. The fixing device according to claim 1, wherein the first pressing member is rotatably provided relative to the first pressing member support around a rotation axis that is substantially orthogonal to both the first direction and the second direction.

3. The fixing device according to claim 2, wherein the rotation axis is located, in the first direction, at one of a position that is coincident with a first center position of the first pressing member in the first direction, and a position that is located downstream of the first center position of the first pressing member in the first direction.

4. The fixing device according to claim 1, wherein the first unit further includes a first base to which each of the first rotating member support and the first pressing member support is pivotally attached.

5. The fixing device according to claim 4, wherein a shaft is provided in the first base and both of the first rotating member support and the first pressing member support are pivotally attached to the shaft.

6. The fixing device according to claim 4, wherein the moving member comprises a second belt, and the second unit further includes:

a second rotating member that is in contact with the second belt and rotatable in a second rotation direction that is opposite to the first rotation direction;

a second pressing member that presses the second belt; and a second base that supports the second rotating member and the second pressing member.

7. The fixing device according to claim 6, wherein the third unit includes a third base;

a cam shaft that extends in a third direction that is substantially orthogonal to the second direction; and a cam that includes a cam surface and that is provided in the third base, rotatably around the cam shaft, and wherein the first base includes a contact part that comes into contact with the cam surface.

8. The fixing device according to claim 7, wherein the first unit is caused to move in the second direction by variation in position of the cam surface in the second direction in accordance with rotation of the cam.

9. The fixing device according to claim 6, wherein the first pressing member has a first dimension in the first direction that is greater than a second dimension of the second pressing member in the first direction.

10. The fixing device according to claim 1, wherein the first unit further includes a first biasing member that biases the first rotating member support and thereby allows the first rotating member to be closer to the second unit in the second direction, and a second biasing member that biases the first pressing member support and thereby allows the first pressing member to be closer to the second unit in the second direction.

11. The fixing device according to claim 10, wherein the first unit further includes a movement limiting part that limits movement of the first rotating member support toward the second unit, and the first pressing member support is limited in movement toward the second unit by coming into contact with part of the first rotating member support.

12. The fixing device according to claim 1, wherein the first unit further includes a heater that generates heat that is transmitted to the first belt.

13. The fixing device according to claim 1, wherein the first belt has a looped shape, and each of the first rotating member and the first pressing member is disposed in space surrounded by the first belt.

14. The fixing device according to claim 1, wherein the first belt and the moving member form a nip portion by coming into contact with each other, and the first belt and the moving member are movable in the first direction in the nip portion.

15. An image forming apparatus provided with a fixing device, the fixing device comprising:

a first unit that includes:

a first belt that is movable in a first direction;

a first pressing member that presses the first belt;

a first pressing member support that supports the first pressing member variably in attitude relative to the first pressing member support;

a first rotating member that is in contact with the first belt and that is rotatable in a first rotation direction; and a first rotating member support that supports the first rotating member variably in position relative to the moving member;

a second unit that includes a moving member and that faces the first unit in a second direction, the moving member being able to come into contact with the first belt and being movable in the first direction; and a third unit that faces the second unit with the first unit positioned in between in the second direction and supported by the second unit and the third unit movably in the second direction between the second unit and the third unit.

16. The image forming apparatus according to claim 15, wherein the fixing device is a belt unit.

17. An image forming apparatus including a belt unit, the belt unit comprising:

a fixing member having a first flat part;

a belt;

a pressure applying member having a second flat part in contact with the first flat part of the fixing member through the belt;

a pressure applying member supporting member that rotatably supports the pressure applying member and that is moveably provided in a moving direction that passes both a first position, and a second position that is situated between the first position and the fixing member; and a biasing member that biases the pressure applying member supporting member and thereby causes the pressure applying member supporting member to approach the fixing member or to be pressed through the belt against the fixing member, wherein, when the pressure applying member supporting member is positioned at the first position, the first flat part is in contact with the second flat part through the belt at a first contact pressure and defines a first nip portion at the first contact pressure, and wherein, when the pressure applying member supporting member is positioned at the second position, the first flat part is in contact with the second flat part through the belt at a second contact pressure that is higher than the first contact pressure and defines a second nip portion at the second contact pressure.

* * * * *